US011304460B1

(12) United States Patent
Biscuiti et al.

(10) Patent No.: US 11,304,460 B1
(45) Date of Patent: Apr. 19, 2022

(54) SPORTS BRA WITH COLLARBONE PROTECTIVE PADDING

(71) Applicant: CHESTEE, Inc., Delray Beach, FL (US)

(72) Inventors: Nicole Biscuiti, Delray Beach, FL (US); Scott Biscuiti, Delray Beach, FL (US)

(73) Assignee: CHESTEE, Inc., Boynton Beach, FL (US)

( * ) Notice: Subject to any disclaimer, the term of this patent is extended or adjusted under 35 U.S.C. 154(b) by 435 days.

(21) Appl. No.: 16/242,533

(22) Filed: Jan. 8, 2019

Related U.S. Application Data

(63) Continuation-in-part of application No. 14/577,354, filed on Dec. 19, 2014, now Pat. No. 1,017,237.
(Continued)

(51) Int. Cl.
*A41D 13/015* (2006.01)
*A41C 3/00* (2006.01)
(Continued)

(52) U.S. Cl.
CPC ..... *A41D 13/015* (2013.01); *A41B 9/06* (2013.01); *A41B 9/12* (2013.01); *A41C 3/0057* (2013.01); *A41C 3/12* (2013.01); *A41D 1/06* (2013.01); *A41D 13/0512* (2013.01); *A41D 13/0518* (2013.01); *A41D 13/0543* (2013.01); *A41C 3/144* (2013.01); *A41D 2300/326* (2013.01); *A41D 2500/50* (2013.01)

(58) Field of Classification Search
CPC ..... A41D 13/0512; A41D 13/0518; A41D 13/0556
USPC ..... 2/463
See application file for complete search history.

(56) References Cited

U.S. PATENT DOCUMENTS 576,880 A 2/1897 McNutt
714,079 A 11/1902 Whitley
(Continued)

FOREIGN PATENT DOCUMENTS

FR 2787298 11/1998
WO 2009018806 2/2009

OTHER PUBLICATIONS

"Throat Collar—Wrap around" Mazon; https://www.justhockey.com.au/index.php?action=prodcatalogue&form_name=view_product&category_id=32&product_id=339&pageID=8133§ionID=0 Aug. 27, 2013.

(Continued)

*Primary Examiner* — Timothy K Trieu
(74) *Attorney, Agent, or Firm* — Fleit Intellectual Property Law; Jon Gibbons

(57) ABSTRACT

A protective shirt includes a chest portion made of garment material including a lining on a side of the chest portion that is closest to a wearer of the protective shirt. At least one layer of neoprene is securely fastened to the lining. The at least one layer of neoprene extends from a left side of the chest portion to a right side of the chest portion, and is located at an area of the chest portion nearest to a clavicle of a wearer of the protective shirt. The at least one layer of neoprene includes a plurality of spaced-apart segments of the at least one layer of neoprene. The protective shirt includes a neoprene neck pad. Embodiments of the protective shirt include cap-sleeve, short sleeve, long sleeve, sleeveless and tank top versions. In one embodiment, the garment material includes nylon and spandex.

13 Claims, 40 Drawing Sheets

Related U.S. Application Data

(60) Provisional application No. 61/918,831, filed on Dec. 20, 2013.

(51) Int. Cl.

| | |
|---|---|
| ***A41C 3/14*** | (2006.01) |
| ***A41D 13/05*** | (2006.01) |
| ***A41B 9/06*** | (2006.01) |
| ***A41B 9/12*** | (2006.01) |
| ***A41D 1/06*** | (2006.01) |
| ***A41C 3/12*** | (2006.01) |

(56) References Cited

U.S. PATENT DOCUMENTS

| | | | | |
|---|---|---|---|---|
| 1,489,080 | A | 3/1923 | Lee | |
| 1,970,130 | A | 3/1933 | Dickenson | |
| 2,435,430 | A * | 2/1948 | Ewing | D01D 10/0454 242/366.2 |
| 3,196,878 | A | 7/1965 | Hedu | |
| 3,257,666 | A * | 6/1966 | Hoffman | A41D 13/0151 2/459 |
| 3,561,009 | A | 2/1971 | Huggins | |
| 3,855,632 | A | 12/1974 | Davis | |
| 4,137,586 | A * | 2/1979 | Evert | B63C 9/093 441/107 |
| 4,397,636 | A | 8/1983 | Ganshaw | |
| 4,425,667 | A * | 1/1984 | Harrison | A41D 13/0153 2/16 |
| 4,507,801 | A | 4/1985 | Kavanagh et al. | |
| 4,649,582 | A * | 3/1987 | Cho | A47G 9/0253 5/636 |
| 4,686,710 | A | 8/1987 | Marston et al. | |
| 4,800,593 | A | 1/1989 | Ruffner | |
| 5,048,125 | A | 9/1991 | Libertini et al. | |
| 5,101,511 | A | 4/1992 | Elverskog | |
| D382,093 | S | 8/1997 | Winfree | |
| 5,675,844 | A | 10/1997 | Guyton et al. | |
| 5,758,363 | A | 6/1998 | Winfree | |
| 5,769,688 | A | 6/1998 | Holliday | |
| D409,818 | S | 5/1999 | Shaffer | |
| 6,000,064 | A | 12/1999 | Alcone et al. | |
| 6,079,056 | A | 6/2000 | Fogelberg | |
| 6,083,080 | A | 7/2000 | Lawson et al. | |
| 6,584,619 | B1 | 7/2003 | Macri | |
| 6,745,400 | B1 * | 6/2004 | Paciorkowski | A41D 13/02 2/69 |
| 6,748,601 | B2 | 6/2004 | LaShoto et al. | |
| 6,862,751 | B1 * | 3/2005 | Wattenbarger | A41D 13/0518 2/463 |
| 6,997,267 | B2 | 2/2006 | Kotovsky et al. | |
| 7,100,216 | B2 | 9/2006 | Matechen et al. | |
| 7,739,753 | B2 | 6/2010 | Jankowski | |
| D674,576 | S | 1/2013 | Johnson | |
| 2003/0167560 | A1 | 9/2003 | LaShoto et al. | |
| 2004/0117895 | A1 * | 6/2004 | Fortner | A41D 27/26 2/267 |
| 2005/0081277 | A1 | 4/2005 | Matechen et al. | |
| 2006/0272071 | A1 * | 12/2006 | Mickle | A41D 13/0518 2/69 |
| 2006/0277647 | A1 | 12/2006 | Dobkin | |
| 2007/0155283 | A1 | 7/2007 | McQueer | |
| 2008/0313793 | A1 | 12/2008 | Skottheim et al. | |
| 2013/0191977 | A1 * | 8/2013 | Mayeri | A41D 13/1245 2/455 |
| 2013/0239309 | A1 | 9/2013 | Webb | |
| 2015/0173435 | A1 | 6/2015 | Biscutti | |
| 2015/0189926 | A1 | 7/2015 | Bunting | |
| 2015/0189927 | A1 | 7/2015 | Bunting | |

OTHER PUBLICATIONS

"Demon Snow Skinn Impact Top—Women's"; http://www.dogfunk.com/demon-snow-skinn-high-impact-top-womens . Last visited on Aug. 27, 2013. Aug. 27, 2013.

"Easton Youth Torso-Tection Shirt A164190"; http://www.directsports.com/catalog/item/Apparel/Easton/2962.html Aug. 27, 2013.

"McDavid Longsleeve HexPad Shirt"; http://www.helmetsandarmor.com/mcdavid-longsleeve-hexpad-shirt.html Aug. 27, 2013.

* cited by examiner

DETAIL: AA

DETAIL: BB

SPORTS BRA WITH COLLARBONE PROTECTIVE PADDING

CROSS-REFERENCE TO RELATED APPLICATION

This application is based upon and claims priority from the following prior application entitled "Protective Shirt", U.S. patent application Ser. No. 14/577,354 with inventor Nicole Biscuiti, filed on Dec. 19, 2014, which is based upon and claim priority to provisional application entitled "Protective Shirt", U.S. Patent Provisional Application Ser. No. 61/918,831 with inventor Nicole Biscuiti, filed on Dec. 20, 2013, the disclosures of which are herein incorporated by reference in their entirety.

BACKGROUND

Field

This invention relates generally to apparel and more particularly to garments with a device for protection from the application of force against a part of the body of a wearer.

Related Art

Some users, especially athletes, when working out using barbells in a front rack position, neck presses, back squats, back of neck jerks, shoulder presses and other exercises sustain bruising and irritation of the shoulder area including the clavicle area and/or the collarbone area. This can lead to severe discomfort including redness, bruising, bleeding in the affected areas, and calcification of the affected areas.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

As required, detailed embodiments of the present invention are disclosed herein; however, it is to be understood that the disclosed embodiments are merely examples of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure and function. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

First Example of Clavicle Protection

Disclosed herein is a protective shirt 100 known as "Chestee". The protective shirt 100 is designed for a female athlete; however, it is foreseeable that the protective shirt can be worn by a male athlete. The protective shirt 100 may be used for working out and weight lifting. The protective shirt 100 can protect a user, i.e., a person who wears the shirt, from abrasions at a shoulder area, including a clavicle/collarbone area, during exercises such as "squat cleans", "power cleans", "front squat", "push press", "push jerk", "split jerk", "thrusters" and "a front rack position".

Figure 1:
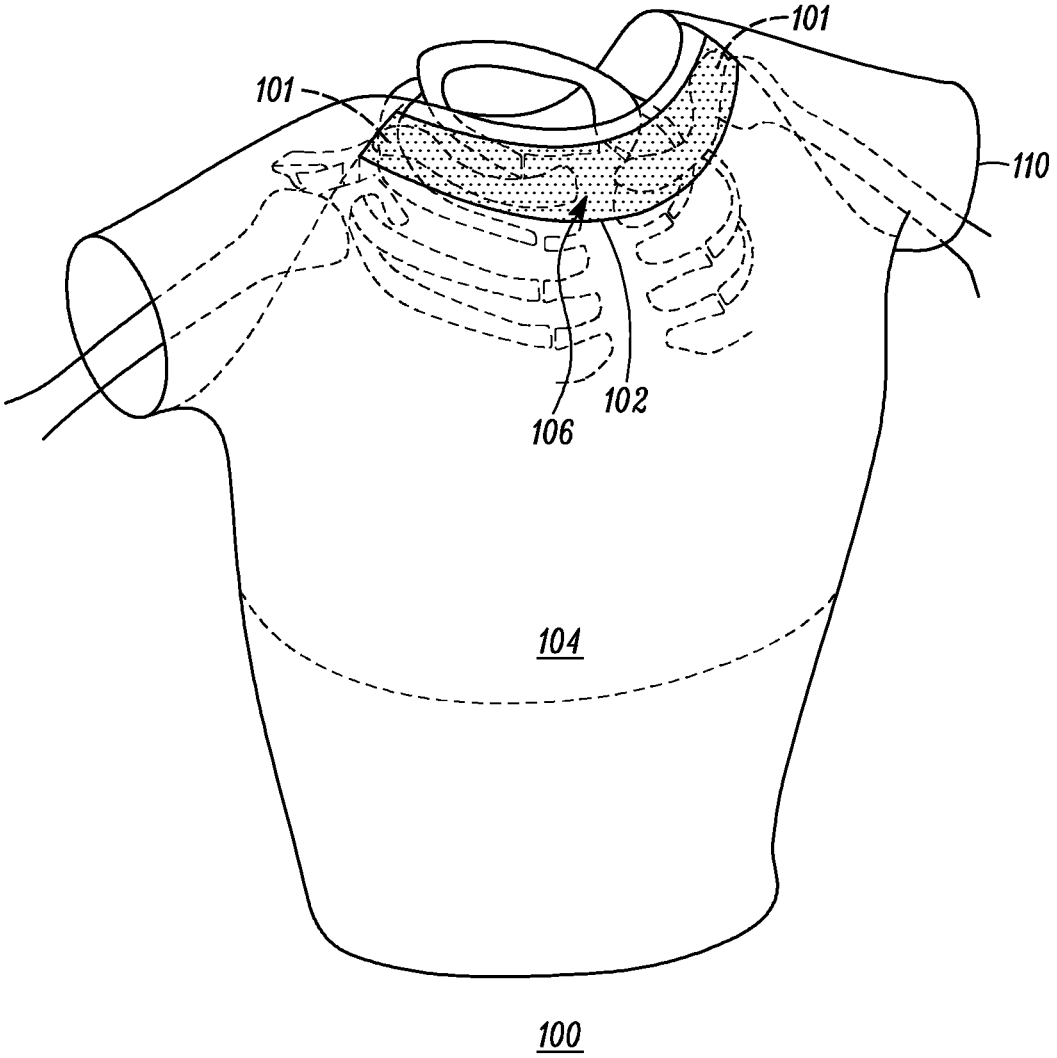
FIG. 1 is front view of a protective shirt, in accordance with one embodiment of the invention.

FIG. 1 is front view of the protective shirt 100 including a shirt and a guard, including cushioning, disposed on an outer surface of a front portion of the shirt at a clavicle/collarbone area 106, in accordance with one embodiment of the invention. The protective shirt 100 comprises one example of a built-in clavicle/collarbone guard 102 located on a front portion 104 of the protective shirt at the clavicle/collarbone area 106. By the term "built-in" it is meant that the clavicle/collarbone guard is part of the protective shirt. The protective shirt 100 includes a shirt 108 whose garment material can be made from any one or more of a variety of fibers, including a natural fiber, a synthetic fiber, and a combination of natural and synthetic fibers. Examples of such a synthetic fiber are nylon and spandex which is also known as elastane. In one embodiment, the fiber of the garment material is weaved as micro-mesh. In one example, the shirt 108 is a conventional shirt or a conventional shirt with a higher neckline. In one example, the guard 102 comprises flexible, built-in padding, or cushioning, 200 (see FIG. 2) made from synthetic rubber such as neoprene which is also known as polycloroprene, or other washable cushioning materials. At least one layer of neoprene extends from a left side of the chest portion to a right side of a chest portion of the protective shirt 100, and is located at an area of the chest portion nearest to a clavicle 101 of a wearer of the protective shirt. The guard 102 includes at least one instance of the cushioning 200 disposed on a surface of the shirt 108.

In another example, one or more pads are fastened, attached and/or sewn to both the inside and outside of the shirt 108 to form layers of cushioning. Fasteners, such as a VELCRO® fastener of Velcro Industries, N.V., of Willemstad, the Netherlands, can make the one or more layers of the material removable. Other non-removable fastening methods include adhesive and stitching or a combination of both. In one example, neoprene stitching is used. The example of the protective shirt 100 shown in FIG. 1 has short sleeves 110.

In still another example, padding is sewn into the shirt 108. In yet another example, the padding is located between the two layers of the fabric of the shirt 108.

Figure 2:
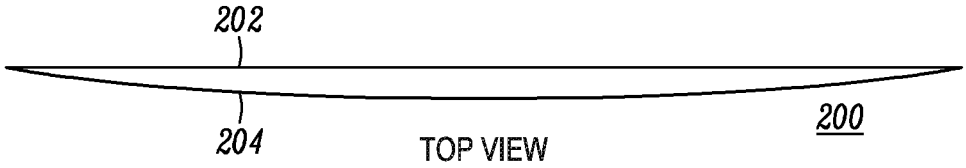
FIG. 2 is a top view of the one example of the cushioning.

FIG. 2 is a top view of the one example of the cushioning 200. The cushioning 200 has a first surface 202 that is approximately flat, and a second surface 204 that is tapered.

Figure 3:
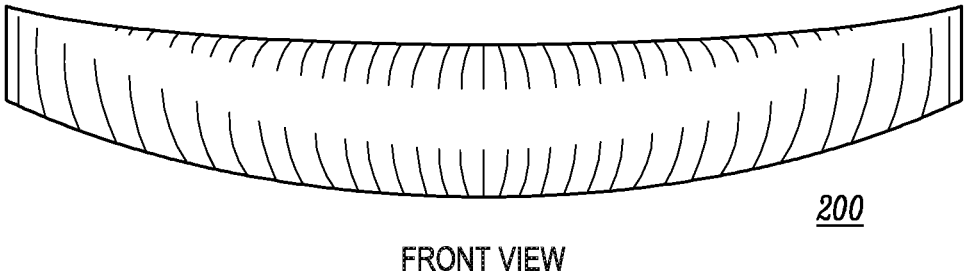
FIG. 3 is a front view of the one embodiment of the cushioning.

FIG. 3 is a front view of the one example of the cushioning 200. In the example shown in FIGS. 2 and 3, the cushioning 200 is, for example, soft plastic, neoprene or tapered molded foam. The tapering is such that the molded foam is thicker near the center of the shirt and thinner towards each sleeve. In another example, the tapering is from the top towards the bottom of the molded foam. This produces a thicker foam towards the neck and thinner foam away from the neck. A combination of tapering may be used. In still another, example, each section of padding is individually tapered to reflect a graduated edge. In yet other embodiments, a step-down tapering may be used.

Figure 4:
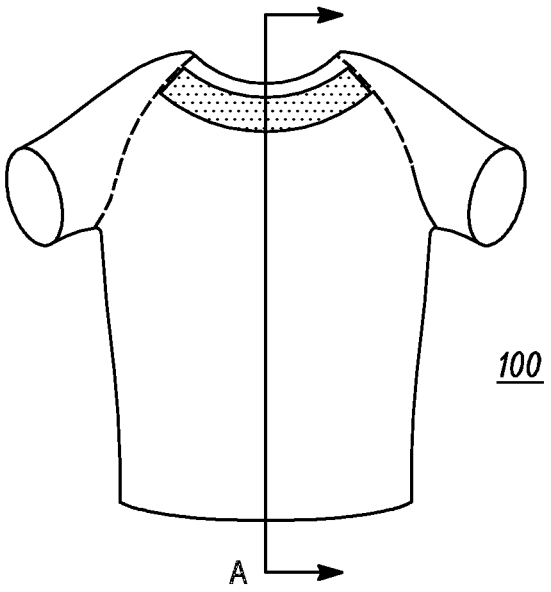
FIG. 4 front view of the protective shirt of FIG. 1 showing cut line A at a center longitudinal axis illustrating the symmetry about the center longitudinal axis of the clavicle/collarbone guard.

FIG. 4 front view of the protective shirt 100 showing cut line A.

Figure 5:
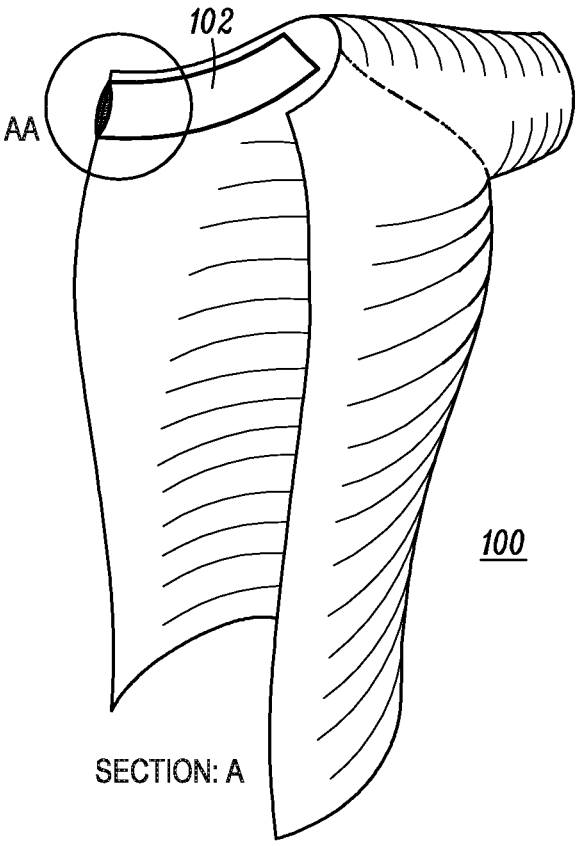
FIG. 5 is a sectional view, through cut line A, of the protective shirt of FIG. 1 illustrating one example the guard disposed on an inner surface of the front portion of the shirt at the clavicle/collarbone area, and showing a circle AA.

FIG. 5 is a sectional view, through cut line A, of the protective shirt 100 illustrating one example of the guard 102 disposed on the front portion 104 of the protective shirt 100 at the clavicle/collarbone area 106, and showing a circle AA.

Figure 6:
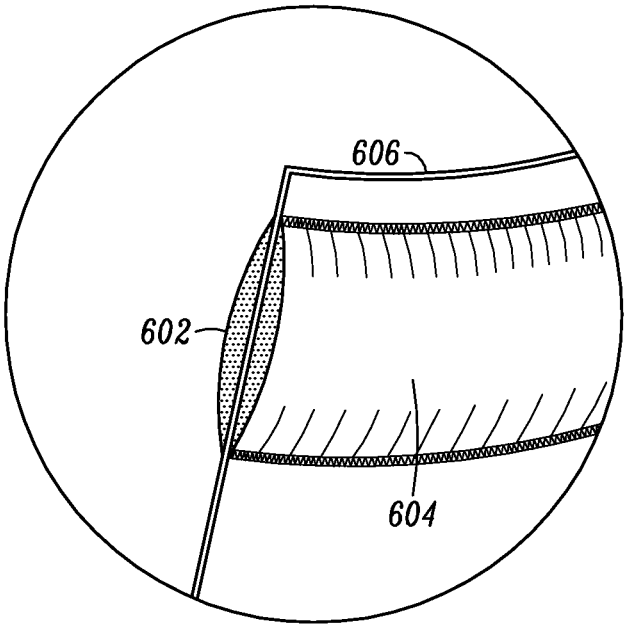
FIG. 6 is an enlargement of the area encompassed by the circle AA.

FIG. 6 is an enlargement of the area encompassed by the circle AA shown in FIG. 5. FIG. 6 shows that one example of the guard 102 comprises outer cushioning 602 disposed on an outer surface 1002 (see FIG. 10) of garment material 606 of the shirt 108, and inner cushioning 604 disposed on an inner surface 1004 (see FIG. 10) of the garment material of the shirt. The outer cushioning 602 and the inner cushioning 604 are resilient, springy, flexible and/or pliable materials. In one example, the inner cushioning 604 is softer than the outer cushioning 602.

In one example, the outer cushioning 602 and the inner cushioning 604 are made of a same material. In another example, the outer cushioning 602 and the inner cushioning 604 are made of different materials.

In one example, the outer cushioning 602 and the inner cushioning 604 have a same size. In another example, the outer cushioning 602 is larger than the inner cushioning 604. In still another example, the outer cushioning 602 is smaller than the inner cushioning 604.

In one example, the outer cushioning 602 and the inner cushioning 604 have a same shape. In another example, the outer cushioning 602 and the inner cushioning 604 have different shapes.

In one example, the outer cushioning 602 and the inner cushioning 604 are first sewn to each other, and then they are sewn to the outer surface 1002 of the garment material 606 of the shirt 108. In another example, the outer cushioning 602 and the inner cushioning 604 are first sewn to each other, and then they are sewn to the inner surface 1004 of the garment material 606 of the shirt 108.

Figure 7:
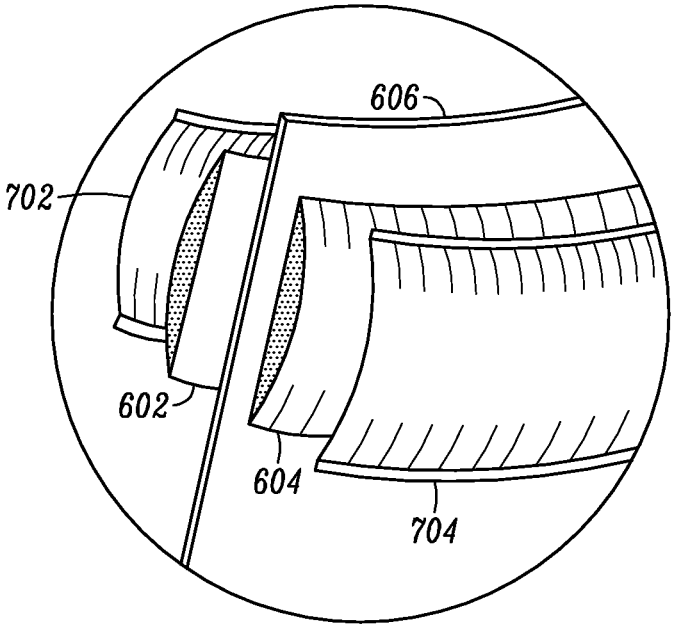
FIG. 7 is an exploded view of the area encompassed by the circle AA.

FIG. 7 is an exploded view of the area encompassed by the circle AA shown in FIG. 5. FIG. 7 shows, from left to right: first fabric 702 is sewn at its edges to the garment material 606 to secure the outer cushioning to the shirt 108; the outer cushioning 602; the garment material 606; the inner cushioning 604; and second fabric 704 is sewn at its edges to the garment material 606 to secure the inner cushioning to the shirt. In one example, the protective shirt 100 includes at least one of an outer pocket (not shown) for holding the outer cushioning 602 and an inner pocket (not shown) for holding the inner cushioning 604. In one example, the cushioning 200 slides into the outside pocket and/or the inside pocket. In such example, when the cushioning 200 is within the outside pocket and/or the inside pocket, the protective shirt 100 is implemented, and when the cushioning is not within the outside pocket and not within the inside pocket, the protective shirt 100 becomes a nearly conventional shirt.

Figure 8:
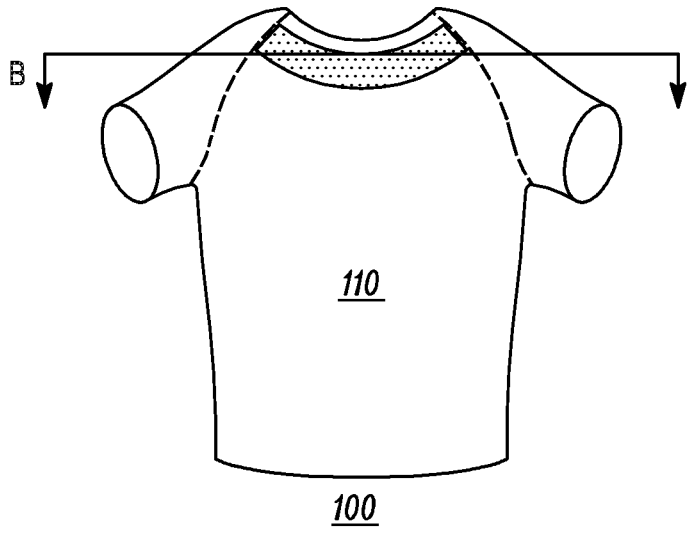
FIG. 8 is front view of the protective shirt of FIG. 1 showing cut line B.

FIG. 8 is front view of the protective shirt 100 showing the front portion 104 of the protective shirt and, showing cut line B.

Figure 9:
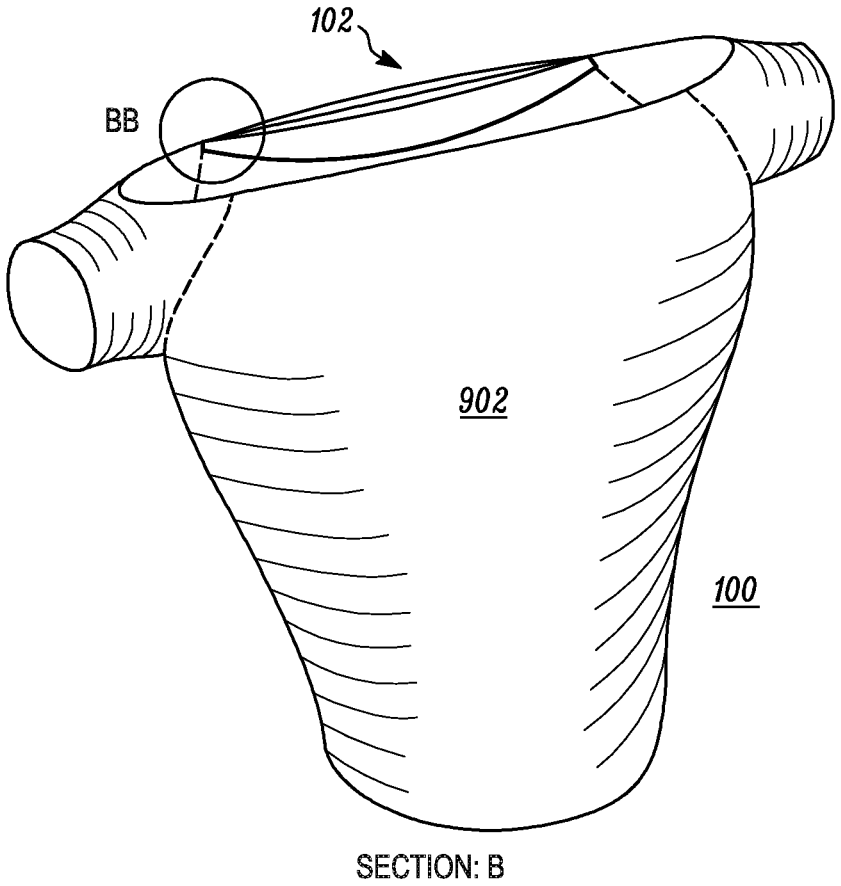
FIG. 9 is a sectional view, through cut line B, of the protective shirt of FIG. 1 illustrating the one example of the guard disposed on an inner surface of the front portion of the shirt at the clavicle/collarbone area, and showing a circle BB.

FIG. 9 is a sectional view, through cut line B, of the protective shirt 100 showing a back portion 902 of the protective shirt 100. FIG. 9 illustrates one example of the guard 102 disposed on the front portion 104 of the protective shirt 100 at the clavicle/collarbone area 106, and showing a circle BB.

Figure 10:
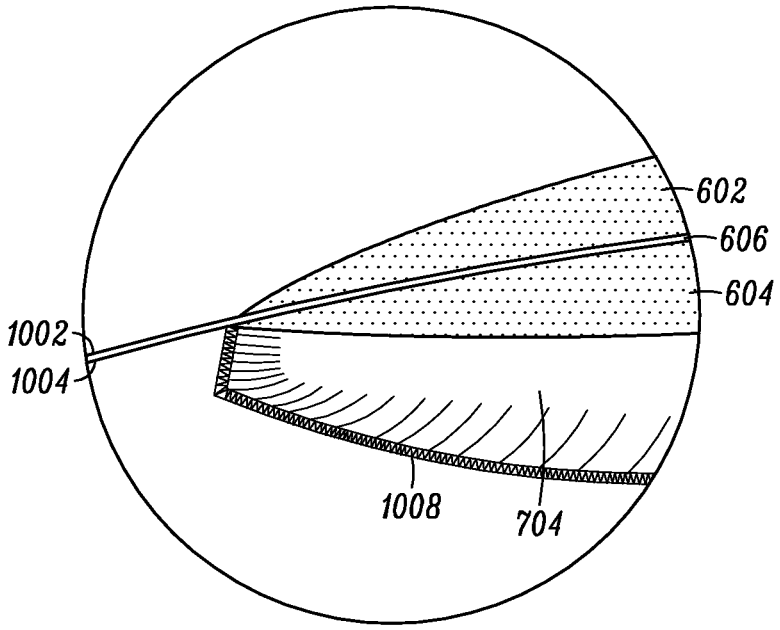
FIG. 10 is an enlargement of the area encompassed by the circle BB.

FIG. 10 is an enlargement of the area encompassed by the circle BB shown in FIG. 9. FIG. 10 shows, from top to bottom: the outer cushioning 602 disposed on the outer surface 1002 of the garment material; the garment material 606; the inner cushioning 604 disposed on the inner surface 1004 of the garment material; and the second fabric 704. Also shown is stitching 1008 at the edges of the second fabric 704.

Second Example of Clavicle Protection

Figure 11:
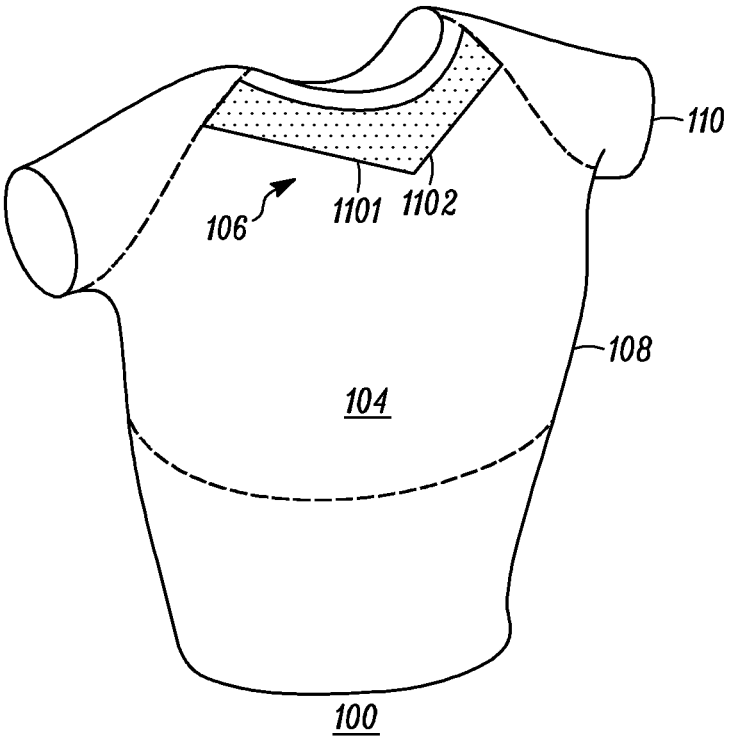
FIG. 11 is front view of the protective shirt including the shirt and another example of the guard.

FIG. 11 is front view of the protective shirt 100 including the shirt 108 with short sleeves 110, and another example of the outer cushioning 1101 and another example of a clavicle/collarbone guard 1102.

Figure 12:
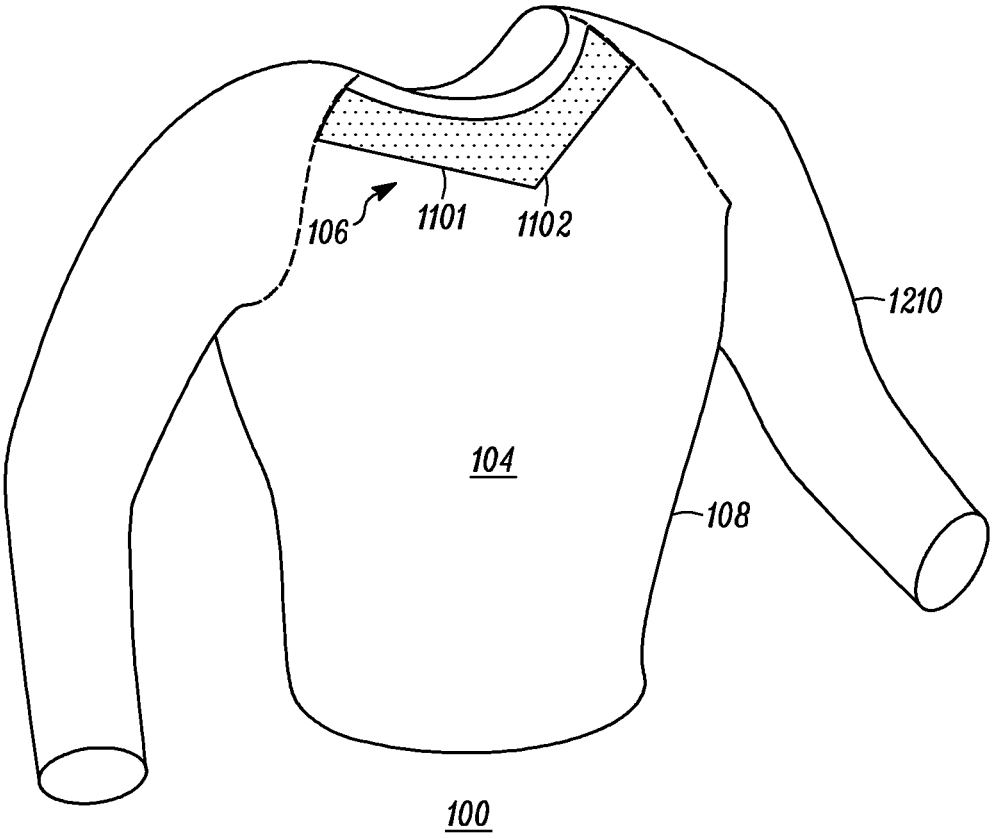
FIG. 12 is a long sleeve version of the protective shirt with the other example of the guard shown in FIG. 11.

FIG. 12 is a front view of the protective shirt 100, including the shirt 108 with long sleeves 1210, with the other example of the outer cushioning 1101 and the other example of the guard 1102.

In one example, the protective shirt 100 includes a shirt 108 made of garment material 606. The shirt 108 has an inner surface 1004 and an outer surface 1002. A front portion 104 of the shirt 108 includes a clavicle/collarbone area 106. Inner cushioning 604 is fastened to the inner surface 1004 at the clavicle/collarbone area 106, and outer cushioning 602 is fastened to the outer surface 1002 at the clavicle/collarbone area. The inner cushioning 604, the garment material 606 at the clavicle/collarbone area 106, and the outer cushioning 602 form a clavicle/collarbone guard 102. The protective shirt 100 protects the shoulder area of a wearer from injury. In one example, the guard 102 includes a plastic guard (not shown) on an outer surface of the outer cushioning 602.

In another example, the protective shirt 100 includes a torso portion having a front 104 with a clavicle/collarbone area 106, a back and a neck opening, a set of left and right arm sleeves which extend from and are directly joined to or integral with the torso portion such that the torso portion and the sleeves form a unitary shirt; and an inner cushioning portion 604 fastened on an inside clavicle/collarbone area 106 of the shirt 108; and an outer cushioning portion 602 fastened on an outside clavicle/collarbone area of the shirt, so as to form at least a three-layer system of the inner cushioning portion, the torso portion, and the outer cushioning portion. The three-layer system of the inner cushioning portion, the torso portion, and the outer cushioning portion protects the collarbone area of a user from injury.

Third Example of Clavicle Protection

Figure 13:
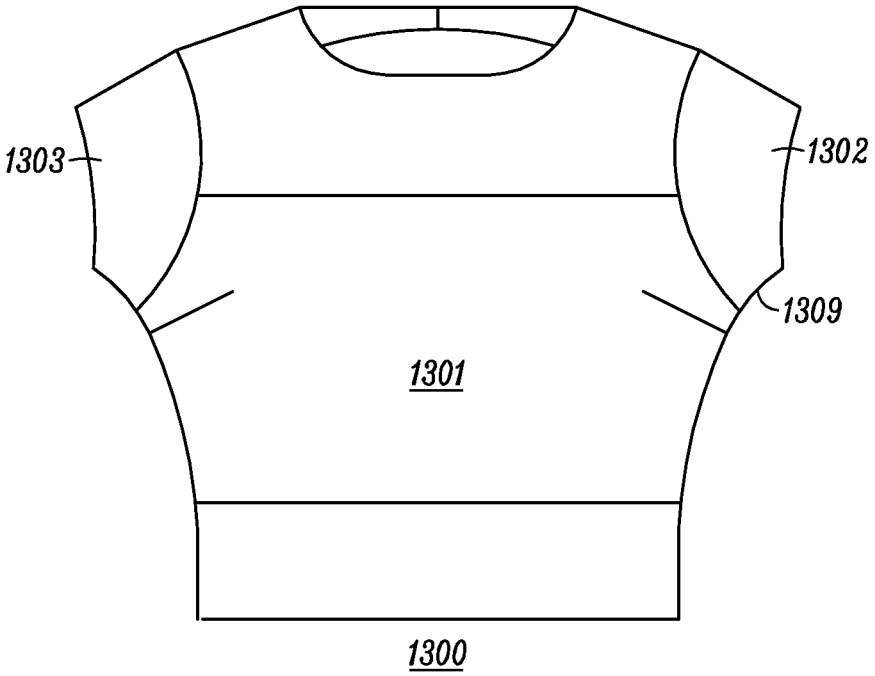
FIG. 13 is front view of a cap-sleeve protective shirt, in accordance with another embodiment of the invention.

FIG. 13 is front view of a cap-sleeve protective shirt 1300, in accordance with another embodiment of the invention. The cap-sleeve protective shirt 1300 comprises a chest portion 1301 and cap-sleeve portions 1302 and 1303. Cap-sleeve portion 1302 is a left sleeve. Cap-sleeve portion 1303 is a right sleeve. The chest portion 1301 comprises a garment material on an outside of the chest portion and a lining on an inside of the chest portion. By "inside" it is meant side of the chest portion 1301 that is closest to a wearer when the cap-sleeve protective shirt 1300 is worn. The cap-sleeve portions 1302 and 1303 comprise a garment material on an outside of each cap-sleeve portion and a lining on an inside of each cap-sleeve portion. In FIG. 13, a bottom-front edge 1309 of the cap-sleeve portion 1302 is indicated.

Figure 14:
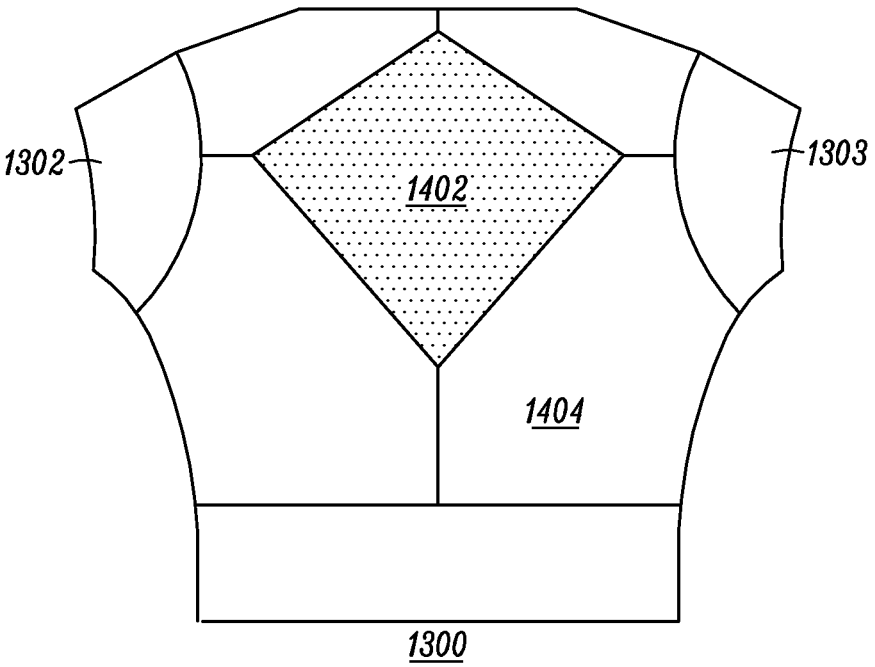
FIG. 14 is a rear view of the cap-sleeve protective shirt of FIG. 13.

FIG. 14 is a rear view of the cap-sleeve protective shirt 1300. The cap-sleeve protective shirt 1300 comprises a back portion 1404. The back portion 1404 comprises a garment material on an outside of the back portion and a lining on an inside of the back portion. The cap-sleeve protective shirt 1300 includes a cut-out portion 1402 in the garment material of the back portion 1404. In one embodiment, the cut-out portion 1402 is shaped as a diamond.

In one embodiment, the chest portion 1301, the cap-sleeve portions 1302 and 1303, and the back portion 1404 of the cap-sleeve protective shirt 1300 comprise a same garment material. The chest portion 1301, the cap-sleeve portions 1302 and 1303, and the back portion 1404 are sewn together to form a shirt, as shown in FIGS. 13 and 14. The cap-sleeve protective shirt 1300 is fully lined. In one embodiment, the cap-sleeve portions 1302 and 1303 and the back portion 1404 are fully lined with self-fabric, i.e., the same fabric as the fabric of the garment material, and the chest portion 1301 is fully lined with a different fabric. In another embodiment, the entire cap-sleeve protective shirt 1300 is fully lined with self-fabric. The garment material can be made from any one or more of a variety of fibers, including a natural fiber, a synthetic fiber, and a combination of natural and synthetic fibers. Examples of such a synthetic fiber are nylon and spandex. In one embodiment, the garment material consists of 87% nylon and 13% spandex. In one embodiment, the fiber of the garment material is weaved as micromesh.

Figure 15:
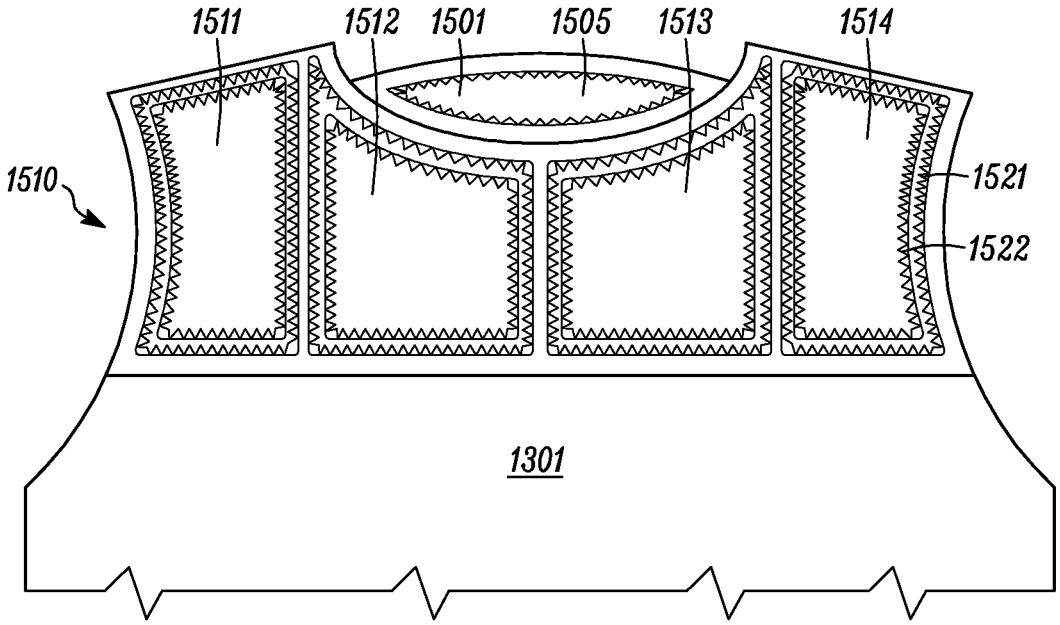
FIG. 15 is a plan view of inside of a chest portion of the cap-sleeve protective shirt of FIG. 13, showing padding.

FIG. 15 is a plan view of inside of the chest portion 1301 of the cap-sleeve protective shirt 1300 showing a neck pad 1501 and a clavicle/collarbone guard 1510. The neck pad 1501 is located near a top of the cap-sleeve protective shirt and the neck pad comprises a single segment and one layer of padding. The chest portion 1301 comprises a neck pocket 1505 formed by and between the garment material. The neck pad 1501 has a same shape as the neck pocket 1505 but is slightly smaller than the neck pocket. The neck pad 1501 is disposed within the neck pocket 1505. The neck pad 1501 is held in place by being tightly fitted within the neck pocket 1505.

The clavicle/collarbone guard 1510 is located below, and on both sides of the neck pad 1501. The clavicle/collarbone guard 1510 is located on a side of the chest portion 1301 that is closest to a wearer of the cap-sleeve protective shirt 1300. The clavicle/collarbone guard 1510 extends from approximately a left side of the chest portion 1301 to approximately a right side of the chest portion. In one embodiment, the clavicle/collarbone guard 1510 extends from approximately 0.25 inch from a left edge of the chest portion 1301 to approximately 0.25 inch from a right edge of the chest portion. The clavicle/collarbone guard 1510 extends from approximately the top of the cap-sleeve protective shirt 1300 to an imaginary line on the shirt that would typically be just below the collarbone area of a wearer when worn. In one embodiment, the clavicle/collarbone guard 1510 extends from approximately 0.25 inch from the top of the cap-sleeve protective shirt 1300 to the imaginary line on the shirt that would typically be just below the collarbone area of a wearer when worn.

The clavicle/collarbone guard 1510 is disposed inside the cap-sleeve protective shirt 1300. The clavicle/collarbone guard 1510 comprises a plurality of segments. In one embodiment, the clavicle/collarbone guard 1510 comprises four (4) segments 1511, 1512, 1513 and 1514. Each segment of the plurality of segments comprises at least one layer of padding. In one embodiment, each segment comprises a first layer 1521 of padding and a second layer 1522 of padding. The first layer 1521 of each segment is disposed on an inner side of the chest portion 1301. Each segment of the first layer 1521 is securely fastened to the chest portion 1301. In one embodiment, each segment of the first layer 1521 is stitched to the lining of the chest portion 1301. By stitching each segment of the first layer 1521 to the lining of the chest portion 1301 rather than to the outer fabric of the chest portion, no stitching, related to the padding, is visible from outside the cap-sleeve protective shirt 1300. In another embodiment, each segment of the first layer 1521 is securely fastened to the chest portion 1301 by means of adhesive. Each segment of the first layer 1521 is spaced apart from an adjacent segment of the first layer and from the edges of the cap-sleeve protective shirt 1300 by approximately 0.25 inch. Each segment of the second layer 1522 is adjacent to an inside surface of a corresponding segment of the first layer 1521. Each corresponding segment of the second layer 1522 is geometrically similar (same shape, but different size) to the segment of the first layer 1521 to which it corresponds.

Each corresponding segment of the second layer 1522 is centered upon and secured to the segment of the first layer 1521 to which it corresponds. In one embodiment, each corresponding segment of the second layer 1522 is stitched to the segment of the first layer 1521 to which it corresponds. In another embodiment, each corresponding segment of the second layer 1522 is stitched to the lining of the chest portion 1301 through the first layer 1521. In still another embodiment, each corresponding segment of the second layer 1522 is secured to the segment of the first layer 1521 to which it corresponds by means of adhesive. Each segment of the first layer 1521 has a length and a width. Each corresponding segment of the second layer 1522 has a length and a width that is smaller than the length and the width of the segment of the first layer 1521 to which it corresponds. In one embodiment, each corresponding segment of the second layer 1522 has a length and a width that is 0.5 inch smaller than the length and the width of the segment of the first layer 1521 to which it corresponds. In one embodiment, each layer 1521 and 1522 of the padding has a thickness of 3 mm. In one embodiment, the padding is neoprene.

The chest portion 1301 includes a plurality of pockets—one pocket for each segment—on the side of the chest portion 1301 that is closest to a wearer of the cap-sleeve protective shirt 1300. The lining of the chest portion 1301 forms one side of each pocket and an additional fabric forms the other side of each pocket. In one embodiment, the additional fabric is of a same type as the garment material. One segment of the clavicle/collarbone guard 1510 is disposed within each of the inner pockets.

Figure 16:
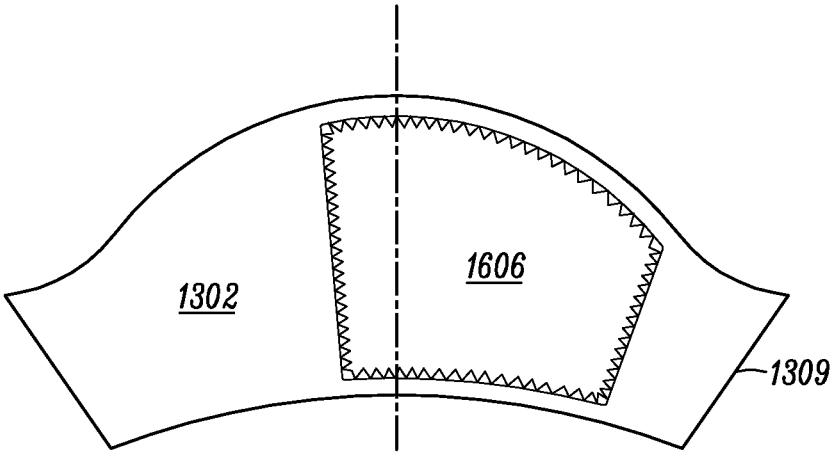
FIG. 16 is a plan view of inside of a sleeve portion of the cap-sleeve protective shirt of FIG. 13, showing padding.

FIG. 16 is a plan view of inside of a cap-sleeve portion 1302 of the cap-sleeve protective shirt 1300, showing a cap-sleeve pad 1606. A centerline 1303 of the cap-sleeve portion 1302 corresponds to a middle of a shoulder of a wearer when the cap-sleeve protective shirt 1300 is worn in a typical manner. The cap-sleeve pad 1606 is fastened to a side of the cap-sleeve portion 1302 that is closest to a wearer when the cap-sleeve protective shirt 1300 is worn in a typical manner. The cap-sleeve pad 1606 is positioned such that at least some of it is on each side of the centerline shown in FIG. 16. The left side of FIG. 16 corresponds to the back side (when worn) of the cap-sleeve portion 1302, and the right side of FIG. 16 corresponds to the front side (when worn) of the cap-sleeve protective shirt. Therefore, FIG. 16 illustrates that most of the cap-sleeve pad 1606 is under the front side of the cap-sleeve portion 1302. The cap-sleeve portion 1302 is lined, and the cap-sleeve pad is sewn to the lining. In one embodiment, each layer of the cap-sleeve pad 1606 has a thickness of 3 mm. In one embodiment, the cap-sleeve pad 1606 is neoprene. The cap-sleeve pad 1606 has a length that is approximately a length of the cap-sleeve portion 1302. In FIG. 16, a bottom-front edge 1309 of the cap-sleeve portion 1302 is indicated. Although not shown, the cap-sleeve protective shirt 1300 also comprises another instance of the cap-sleeve pad 1606 at the cap-sleeve portion 1303.

Fourth Example of Clavicle Protection

Figure 17:
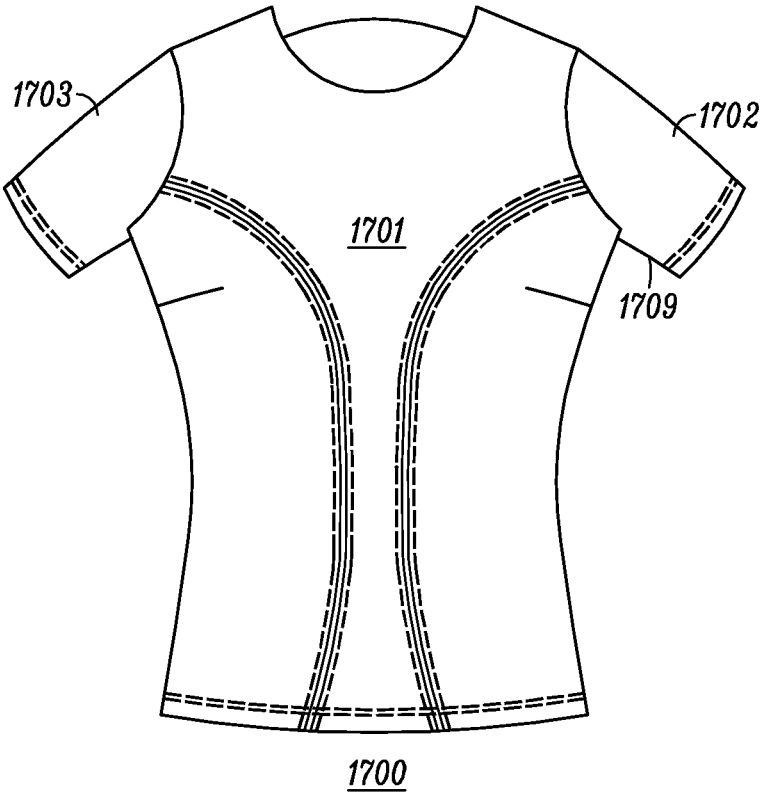
FIG. 17 is a front view of a short-sleeve protective shirt, in accordance with still another embodiment of the invention.

FIG. 17 is a front view of a short-sleeve protective shirt 1700, in accordance with still another embodiment of the invention. The short-sleeve protective shirt 1700 comprises a chest portion 1701 and short-sleeve portions 1702 and 1703. In FIG. 17, a bottom-front edge 1709 of the short-sleeve portion 1702 is indicated.

Figure 18:
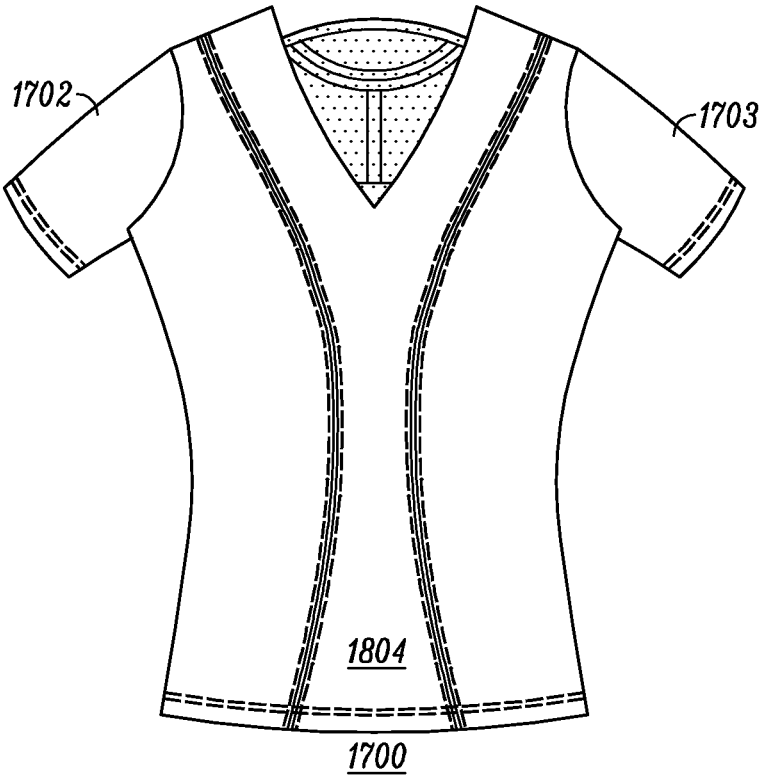
FIG. 18 is a rear view of the short-sleeve protective shirt of FIG. 17.

FIG. 18 is a rear view of the short-sleeve protective shirt 1700. The short-sleeve protective shirt 1700 comprises a back portion 1804. In one embodiment, the back portion 1804 lacks any cut-out portion. The chest portion 1701, the short-sleeve portions 1702 and 1703, and the back portion 1804 are sewn together to form a shirt, as shown in FIGS. 17 and 18.

Figure 19:
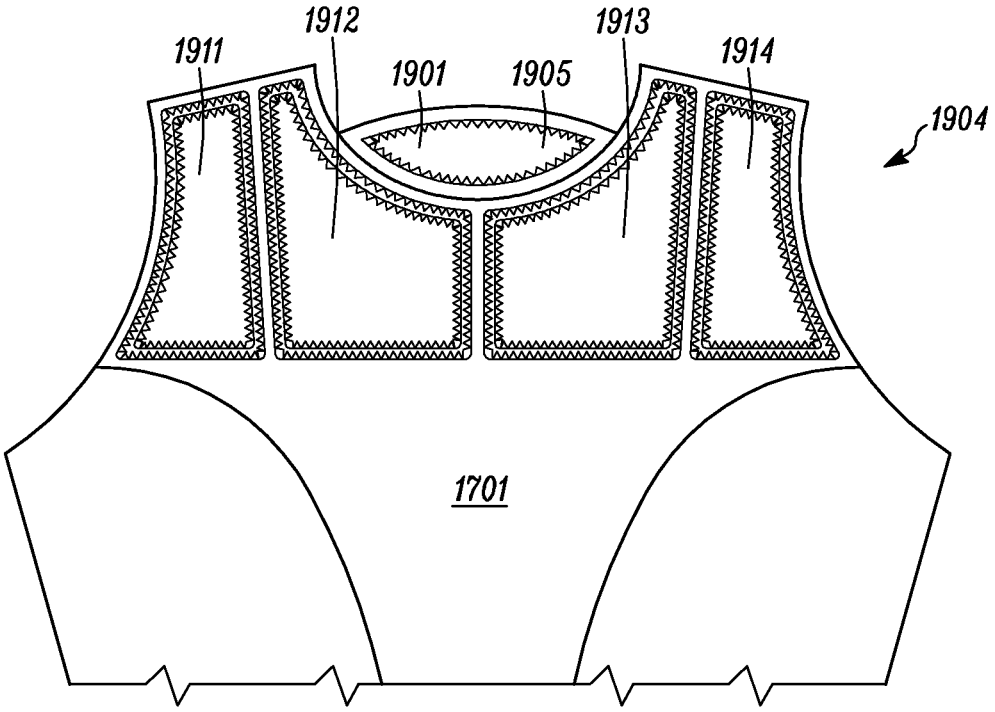
FIG. 19 is a plan view of inside of a chest portion of the short-sleeve protective shirt of FIG. 17, showing padding.

FIG. 19 is a plan view of inside of the chest portion 1701 of the short-sleeve protective shirt 1700, showing a neck pad 1901 and a clavicle/collarbone guard 1904. The neck pad 1901 comprises a single layer of padding. The chest portion 1701 comprises a neck pocket 1905 formed by and between the garment material. The clavicle/collarbone guard 1904 comprises a plurality of segments 1911-1914. Each segment comprises two layers of padding.

Figure 20:
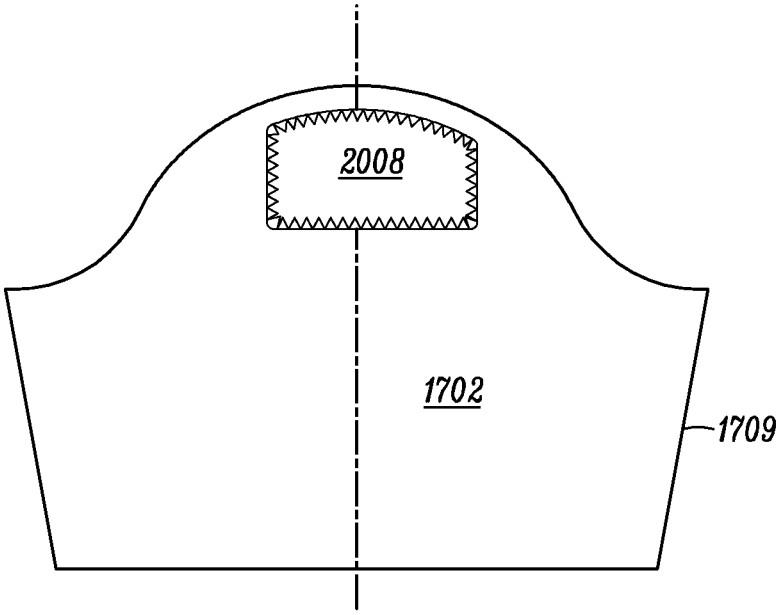
FIG. 20 is a plan view of inside of a sleeve portion of the short-sleeve protective shirt of FIG. 17, showing padding.

FIG. 20 is a plan view of inside of short-sleeve portion 1702 of the short-sleeve protective shirt 1700, showing a short-sleeve pad 2008. The short-sleeve portion 1702 has a length that is longer than the length of the cap-sleeve portion 1302; therefore, the short-sleeve portion 1702 extends substantially beyond the short-sleeve pad 2008. The left side of FIG. 20 corresponds to the back of the short-sleeve protective shirt 1700, and the right side of FIG. 20 corresponds to the front of the short-sleeve protective shirt. The short-sleeve pad 2008 is securely fastened to an inside surface of the short-sleeve portion 1702. In FIG. 20, a bottom-front edge 1709 of the short-sleeve portion 1702 is indicated. Although not shown, the short-sleeve protective shirt 1700 also comprises another instance of the short-sleeve pad 2008 at the short-sleeve portion 1703.

Except for length of sleeves, the short-sleeve protective shirt 1700 is similar to the cap-sleeve protective shirt 1300 described hereinabove; therefore, the short-sleeve protective shirt will not be described in further detail.

Fifth Example of Clavicle Protection

Figure 21:
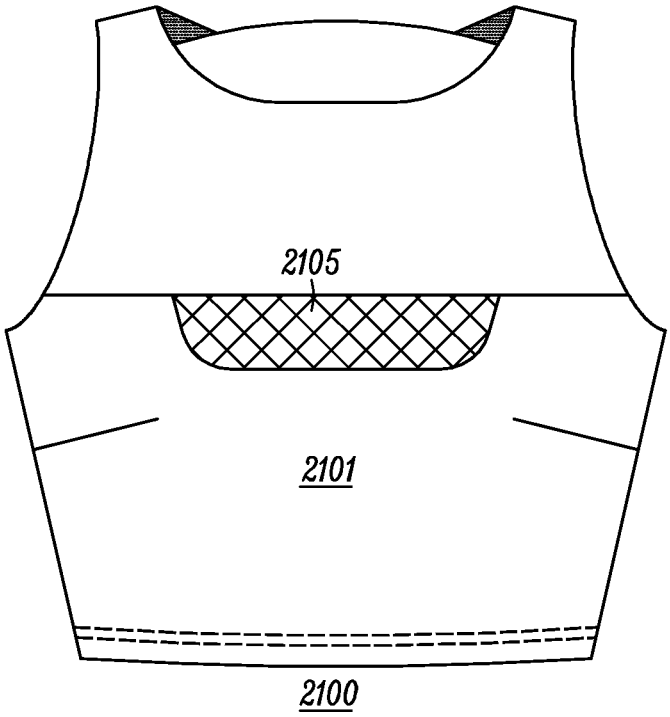
FIG. 21 is a front view of a tank-top protective shirt, in accordance with yet another embodiment of the invention.

FIG. 21 is front view of a tank-top protective shirt 2100, in accordance with yet another embodiment of the invention. The tank-top protective shirt 2100 comprises a chest portion 2101. In one embodiment, the chest portion 2101 comprises cut-out portion 2105. At the cut-out portion 2105, the garment material is replaced with power mesh fabric.

Figure 22:
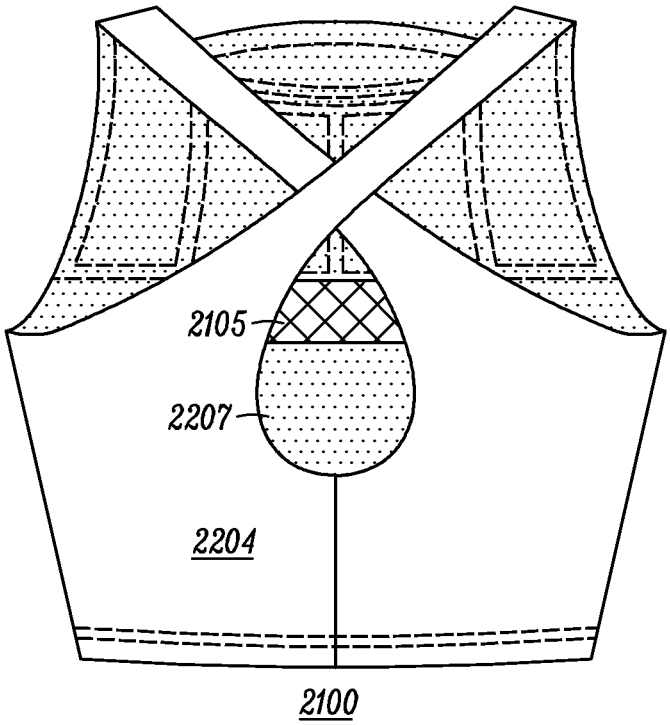
FIG. 22 is a rear view of the tank-top protective shirt of FIG. 21.

FIG. 22 is a rear view of the tank-top protective shirt 2100. The tank-top protective shirt 2100 comprises a back portion 2204. In one embodiment, the back portion 2204 comprises a tear drop portion 2207 that lacks any garment material. The chest portion 2101 and the back portion 2204 are sewn together to form a shirt, or tank top, as shown in FIGS. 21 and 22.

Figure 23:
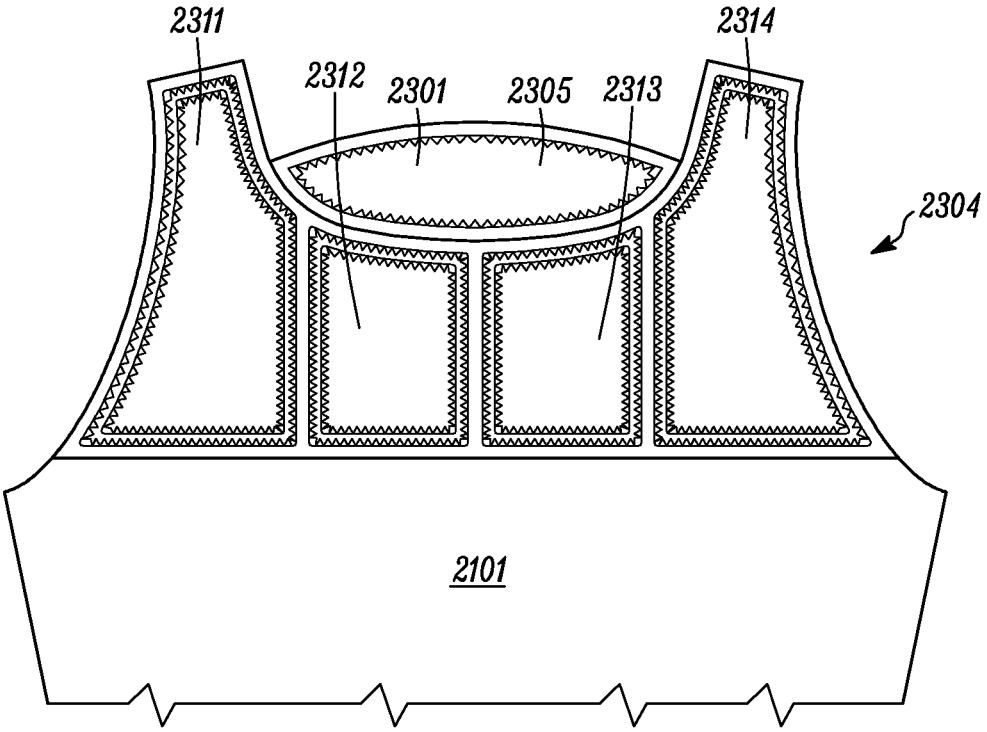
FIG. 23 is a plan view of inside of a chest portion of the tank-top protective shirt of FIG. 21, showing padding.

FIG. 23 is a plan view of inside of the chest portion 2101 of the tank-top protective shirt 2100, showing a neck pad 2301 and a clavicle/collarbone guard 2304. The neck pad 2301 comprises a single layer of padding. The chest portion 2101 comprises a neck pocket 2105 formed by and between the garment material. The clavicle/collarbone guard 2304 comprises a plurality of segments 2311-2314. Each segment comprises at least one layer of padding. In one embodiment, each segment comprises two layers of padding.

Except for the fact that the tank-top protective shirt 2100 lacks the cap-sleeve pad 1606 and the cap-sleeve portions 1302 and 1303, in many respects the tank-top protective shirt 2100 is similar to the cap-sleeve protective shirt 1300 described hereinabove; therefore, the tank-top protective shirt will not be described in further detail.

Another embodiment of the invention is a sleeveless protective shirt (not shown). The sleeveless protective shirt is similar in most respects to the cap-sleeve protective shirt 1300, except that the sleeveless protective shirt lacks the cap-sleeve pad 1606, and, of course, lacks the cap-sleeve portions 1302 and 1303.

Example of Truncated Z-Shape

Figure 24:
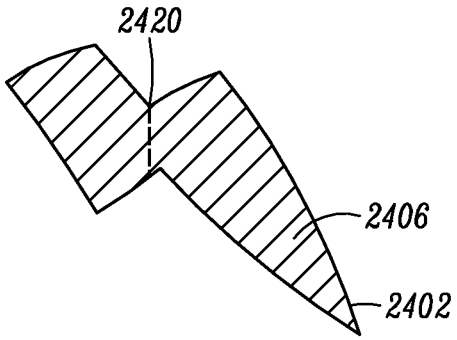
FIG. 24 is a front view of a truncated z-shape embodiment of a cushioning pad.
Figure 25:
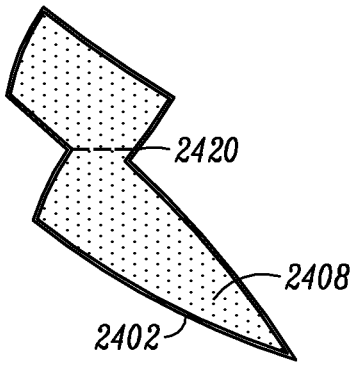
FIG. 25 is a back view of the truncated z-shape embodiment of the cushioning pad of FIG. 24.
Figure 26:
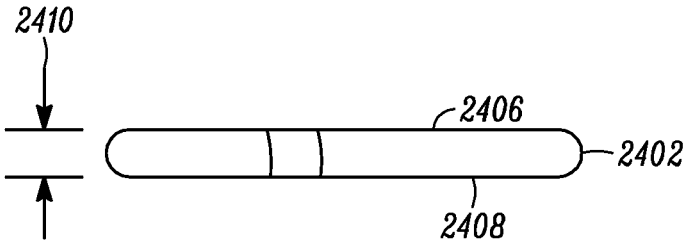
FIG. 26 is a side view of the truncated z-shape embodiment of the cushioning pad of FIG. 24.
Figure 27:
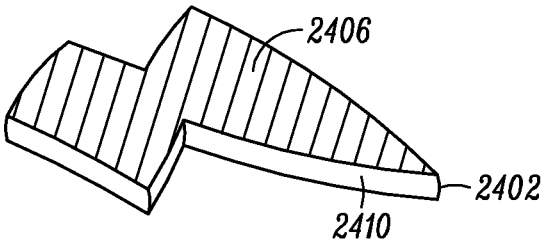
FIG. 27 is a front perspective view of the truncated z-shape embodiment of the cushioning pad of FIG. 24.

FIG. 24 is a front view of a truncated z-shape or lightning bolt embodiment of a cushioning pad 2402 with a front side 2406. The cushioning pad 2402 can be made of neoprene, foam, or plastic. FIG. 25 is a back view of the truncated z-shape embodiment of the cushioning pad 2402. The z-shape allows the cushioning pad 2402 to flex along transversal line 2420. An adhesive, hypoallergenic flexible acrylic, is disposed on the back side 2408 of the cushioning pad 2402. These truncated z-shapes or sticky shapes use the adhesive backing 2408 that sticks onto the skin of the user. FIG. 26 is a side view of the truncated z-shape embodiment of the cushioning pad 2402 showing a depth or thickness 2410. It is important to note that the pad 2402 can be tapered in a longitudinal direction or latitudinal direction or both (as shown in FIG. 2 and FIG. 6). The shape and dimension of the pad can vary. The inventors have discovered that 2 mm to 9 mm thickness of the pads works advantageously. The pad 2402 can be made of neoprene, foam, or other synthetic or natural washable materials. FIG. 27 is a front perspective view of the truncated z-shape embodiment of the cushioning pad 2402.

Figure 28:
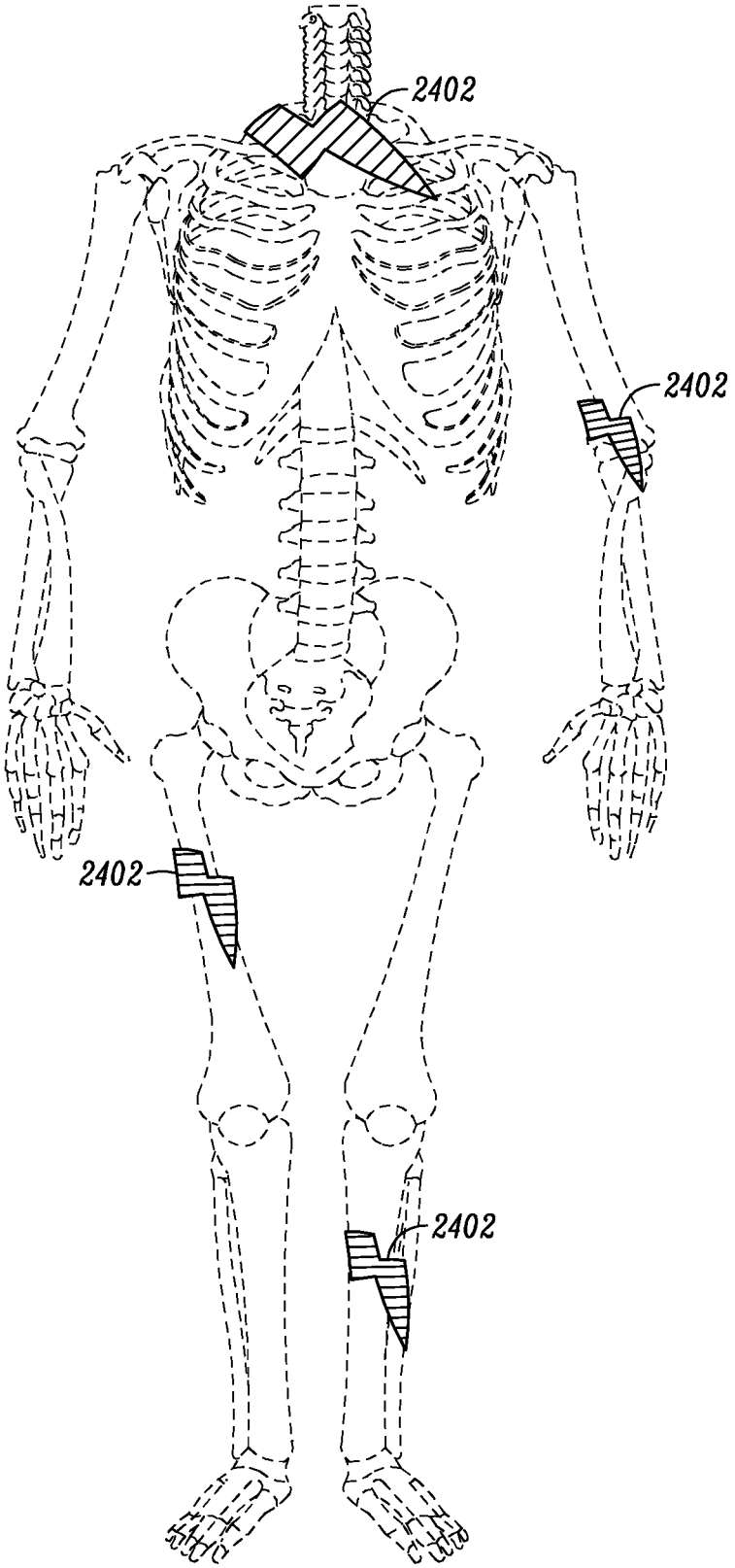
FIG. 28 is front view of the truncated z-shape embodiment of FIG. 24, illustrating various placements within a garment to protect areas of a user.

FIG. 28 is front view of the truncated z-shape embodiment of FIG. 24, illustrating various placements of cushioning pad 2402 within a garment to protect areas of a user. The protect areas shown starting from the top is clavicle area or collar bone for example weight lifting, elbow area for example basketball, thigh or femur area for example weight lifting or lacrosse, and shin area for example soccer. Other areas on the user are also possible such as knees. It is important to note that more than one cushioning pad 2402 can be placed on an area such as clavicle or even layers on top of one another. The outer layer 2406 of the cushioning pad protects the wearer from impact of any kind, with uses for soccer, baseball, basketball, lacrosse, hockey, fencing and items such as barbells, weights—anything that has impact on the wearer. This can be placed on any body part to be used for protection from impact.

Example of Multiple Piece

Figure 29:
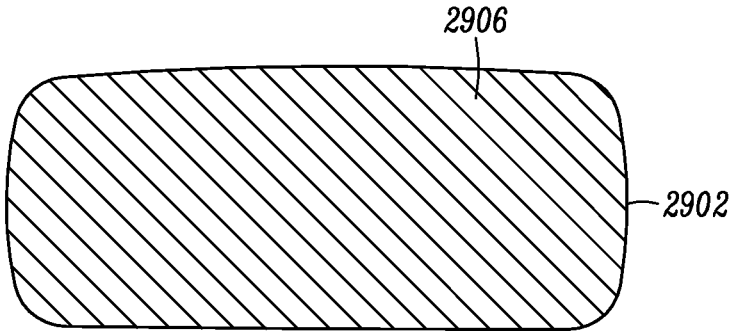
FIG. 29 is a front view of a multiple piece embodiment of a cushioning pad.
Figure 30:
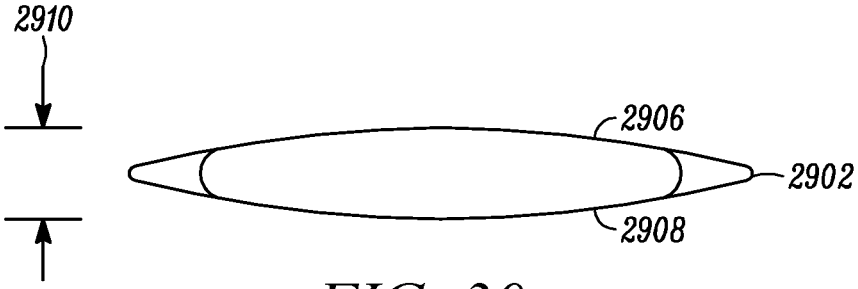
FIG. 30 is a tapered side view of the multiple piece embodiment of the cushioning pad of FIG. 29.

FIG. 29 is a front view of a multiple piece embodiment of a cushioning pad 2902 with a front side 2906 and a back side 2908. FIG. 30 is a tapered side view of the multiple piece embodiment of the cushioning pad 2902 with a depth 2910. It is important to note that the pad 2902 can be tapered in a longitudinal direction or latitudinal direction or both (as shown in FIG. 2 and FIG. 6). The shape and dimension of the pad can vary. The inventors have discovered that 2 mm to 7 mm thickness of the pads works advantageously. The pad 2902 can be made of neoprene, foam, or other synthetic or natural washable materials.

Figure 31:
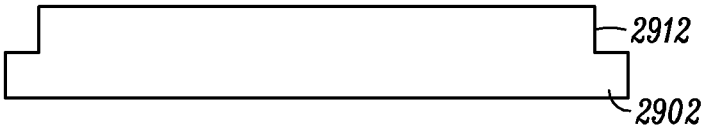
FIG. 31 is a stepped side view of the multiple piece embodiment of the cushioning pad of FIG. 29.
Figure 32:
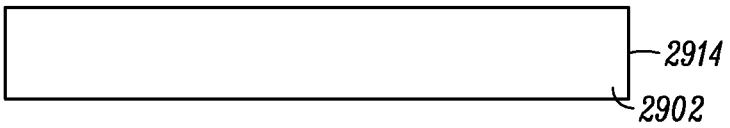
FIG. 32 is a side view of the multiple piece embodiment of the cushioning pad of FIG. 29.

FIG. 31 is a stepped side view 2912 of the multiple piece embodiment of the cushioning pad of 2902. FIG. 32 is a side view 2914 of the multiple piece embodiment of the cushioning pad of FIG. 29.

Figure 33:
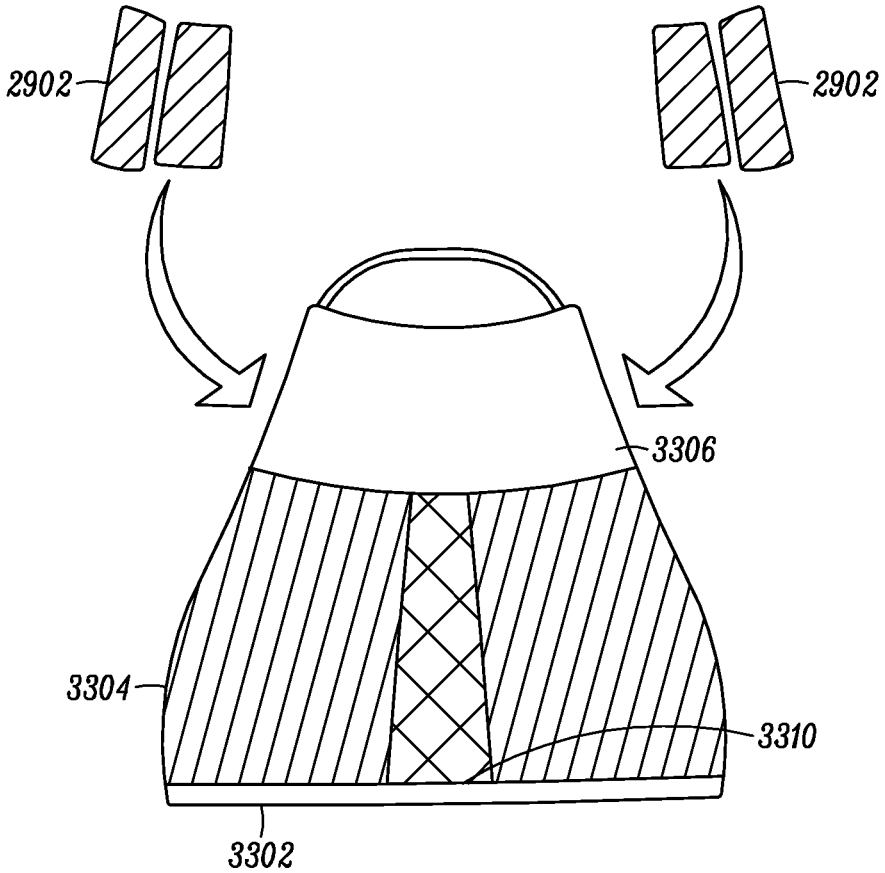
FIG. 33 is a front view showing the placement of the multiple piece embodiment of FIG. 29 inside a clavicle area of sports top or sports bra type garment.

FIG. 33 is a front view showing the placement of the multiple piece embodiment of cushioning pad 2902 inside a clavicle area 3306 of sports top or sports bra 3302 type garment. The sports top can have material 3304 that is a different type and thickness along the torso as compared with the clavicle area 3306 including a sheen area 3310 to give an aesthetically pleasing appearance, comfort and breathability to the wearer or user.

Figure 34:
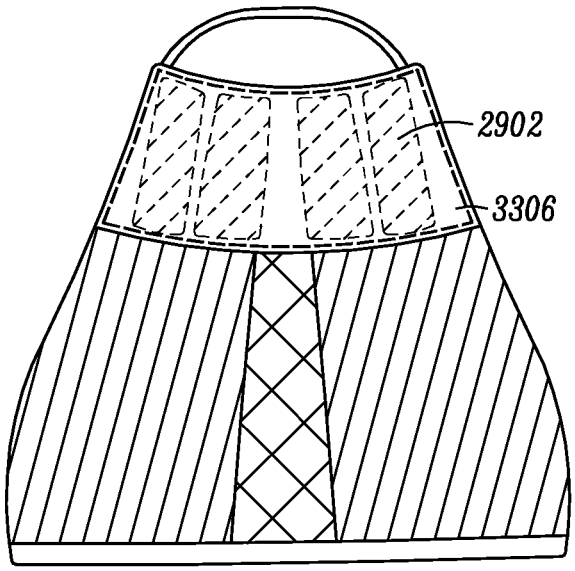
FIG. 34 is a front view showing the placement of the multiple piece embodiment of FIG. 29 inside a clavicle area of a sports top or sports bra type garment after being sewn in place.

FIG. 34 is a front view showing the placement of the multiple piece embodiment of cushioning pad 2902 inside a clavicle area of a sports top or sports bra type garment after being sewn in place.

Figure 35:
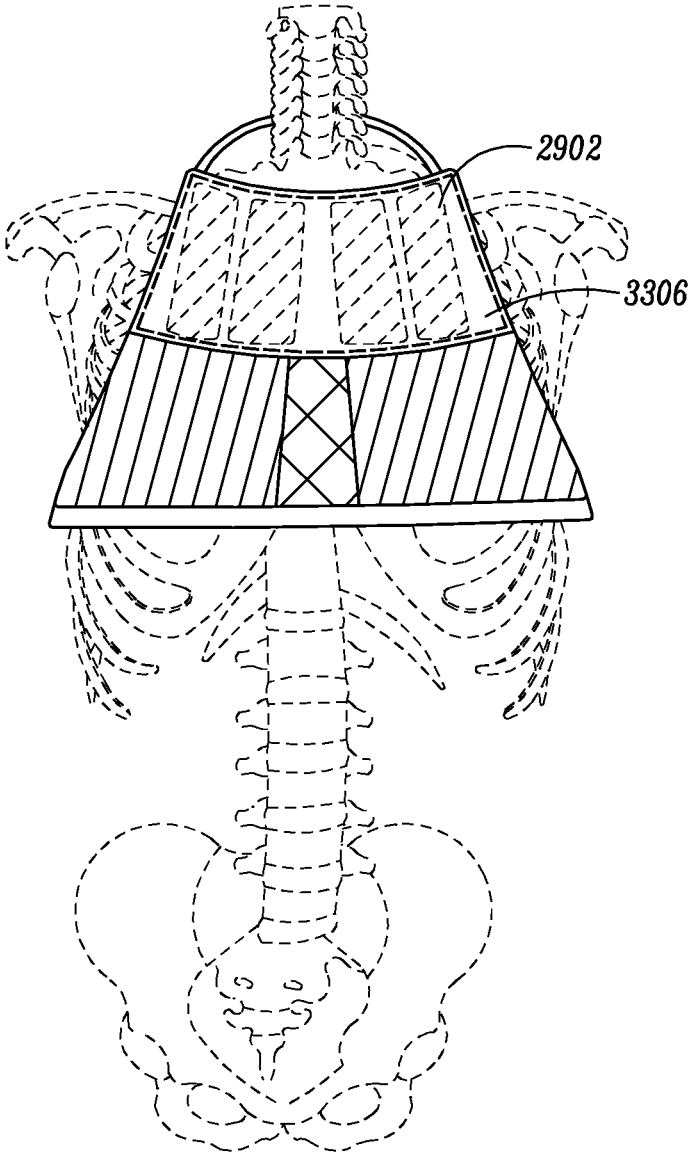
FIG. 35 is a front view showing the placement of the multiple piece embodiment of FIG. 29 inside a clavicle area of a sports top or sports bra type garment after being sewn in place to protect areas of a user.

FIG. 35 is a front view showing the placement of the multiple piece embodiment of cushioning pad 2902 inside a clavicle area of a sports top or sports bra type garment after being sewn in place to protect areas of a user.

Two or more pieces of padding sewn into a garment to provide collarbone protection from impact for the wearer. Each piece of padding is tapered, with the thickest portion in the center, and the thinnest portions at the outside edges (as shown in FIG. 2 and FIG. 6). The pieces of padding overlay the clavicles of a user when the garment is being worn by the user. The removable pads may be disposed in pockets within the garment or fasten with hook and loop fasteners such as Velcro® brand fasteners, or adhesive.

Example of Removable Piece

Figure 36:
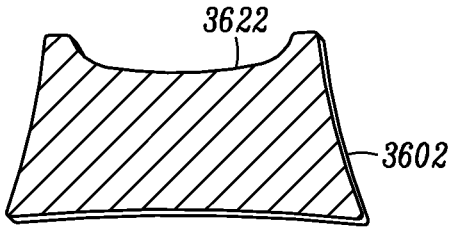
FIG. 36 is a front view of a trapezoidal shape removable piece embodiment of a cushioning pad.
Figure 37:
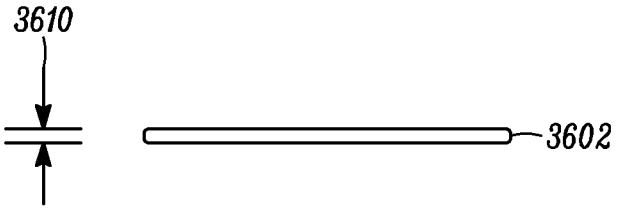
FIG. 37 is a side view of the trapezoidal shape removable piece embodiment of the cushioning pad of FIG. 36.

FIG. 36 is a front view of a trapezoidal shape removable piece embodiment of a cushioning pad 3602. A semi-circular cutout 3622 to accommodate the wearer's neck is shown. It is important to note that the pad 3602 can be tapered in a longitudinal direction or latitudinal direction or both (as shown in FIG. 2 and FIG. 6). The shape and dimension of the pad 3602 can vary. FIG. 37 is a side view of the trapezoidal shape removable piece embodiment of the cushioning pad 3602 with depth 3610. The inventors have discovered that 2 mm to 9 mm thickness of the pads works advantageously. The pad 3602 can be made of neoprene, foam, or other synthetic or natural washable materials.

Figure 38:
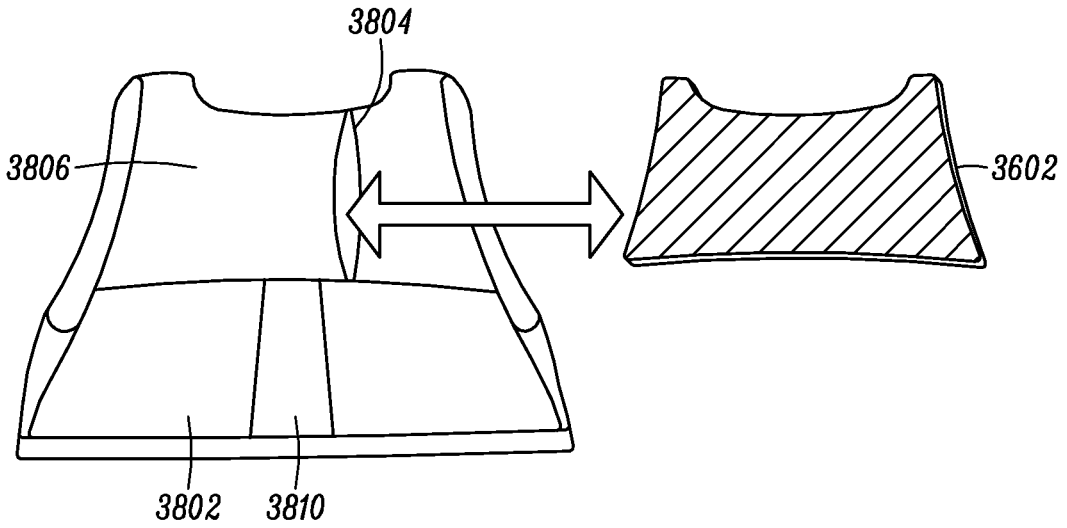
FIG. 38 is a front view showing the placement of the trapezoidal shape removable piece embodiment of the cushioning pad of FIG. 36 inside a pocket within clavicle area of a sports top or sports bra type garment.
Figure 39:
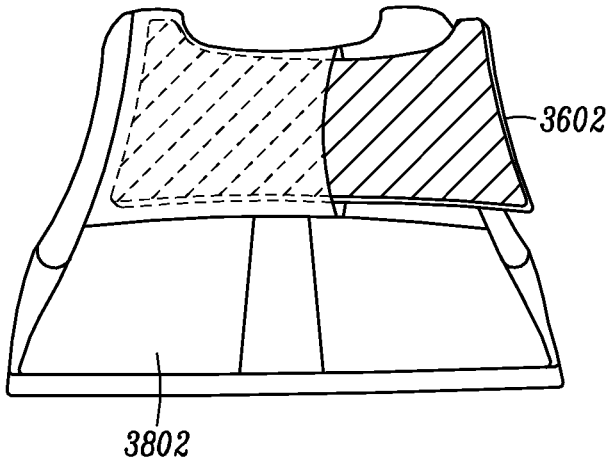
FIG. 39 is a front view showing the placement of the trapezoidal shape removable piece embodiment of the cushioning pad of FIG. 36 inside a pocket within clavicle area of a sports top or sports bra type garment.

FIG. 38 is a front view showing the placement of the trapezoidal shape removable piece embodiment of the cushioning pad of FIG. 36 inside a pocket opening 3804 within clavicle area 3806 of a sports top or sports bra type garment 3802. FIG. 39 is a front view showing the placement of the trapezoidal shape removable piece embodiment of the cushioning pad of FIG. 36 inside a pocket opening 3804 within clavicle area of a sports top or sports bra type garment 3802. The sports top can have material 3802 that is a different type and thickness along the torso as compared with the clavicle area 3806 including a sheen area 3810 to give an aesthetically pleasing appearance, comfort and breathability to the wearer or user.

Figure 40:
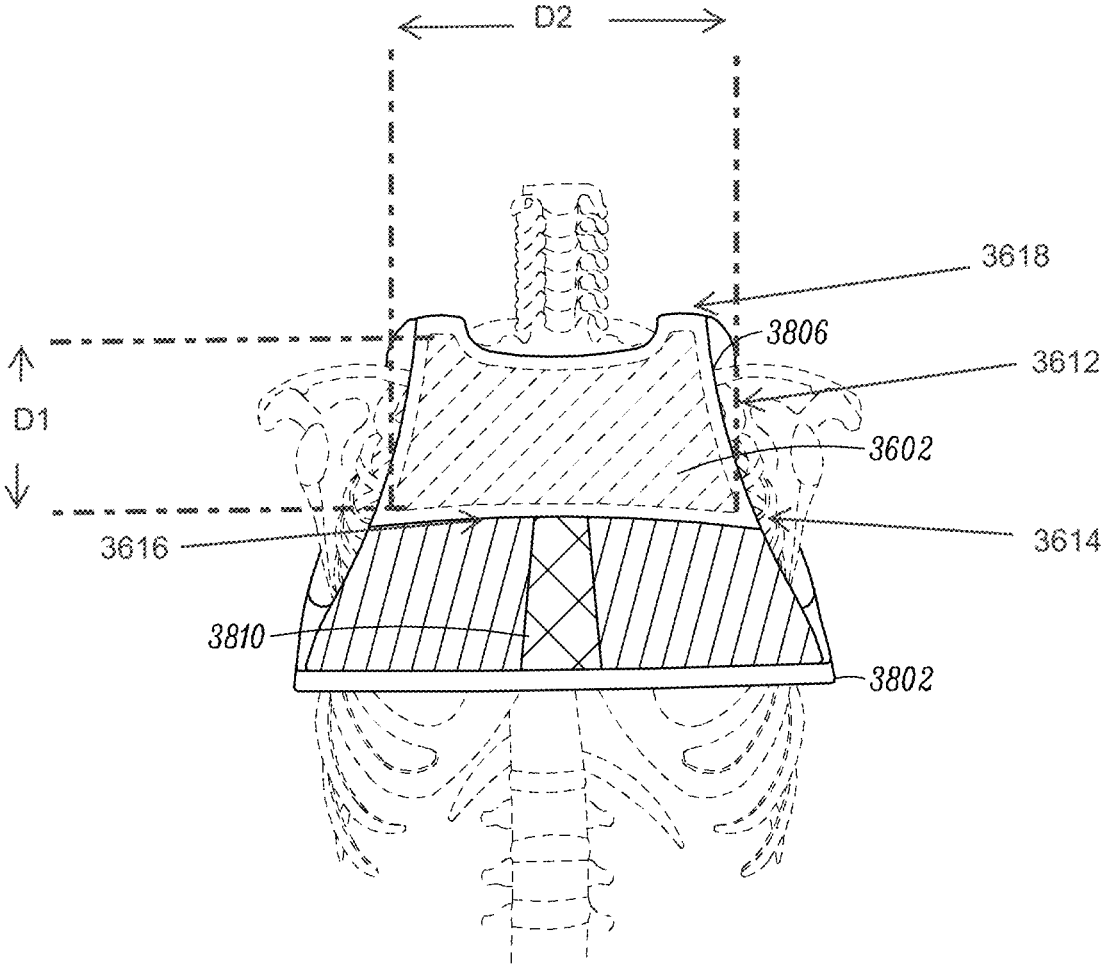
FIG. 40 is a front view showing the placement of the trapezoidal shape removable piece embodiment of the cushioning pad of FIG. 36 inside a pocket within clavicle area of a sports top or sports bra type garment.

FIG. 40 is a front view showing the placement of the trapezoidal shape removable piece embodiment of the cushioning pad 3602 inside a pocket opening 3804 within clavicle area 3806 of a sports top or sports bra type garment 3802. As shown, 3612 is a wearer's first rib, 3614 is the wearer's third rib, 3616 is a location above the wearer's breast area, and 3618 is the upper portion of the cushioning pad near the wearer's shoulder. Also shown is a dimension D1 for the left/right side dimensions of the cushioning pad and dimension D2 for the lower side dimension of the cushioning pad. As illustrated in FIG. 40, D2 is approximately twice the distance of D1.

One or more pieces of padding sewn into a garment to provide collarbone protection from impact for the wearer. Each piece of padding is tapered, with the thickest portion in the center, and the thinnest portions at the outside edges (as shown in FIG. 2 and FIG. 6). The pieces of padding overlay the clavicles of a user when the garment is being worn by the user. The removable pads may be disposed in pockets within the garment or fasten with hook and loop fasteners such as Velcro® brand fasteners, or adhesive.

Figure 41:
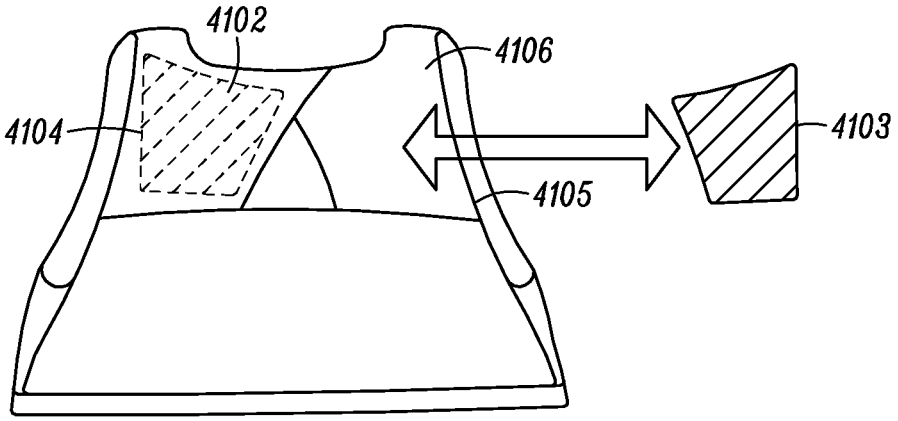
FIG. 41 is a front view showing the placement of a two separate piece removable piece embodiment of the cushioning pad of FIG. 36 inside two separate pockets within clavicle area of a sports top or sports bra type garment.

FIG. 41 is a front view showing the placement of a two separate piece removable piece embodiment of the cushioning pad 4102, 4103 inside two separate pockets 4104 and 4105 within clavicle area of a sports top or sports bra type garment 4102. The pockets 4104 and 4105 are shown as side pockets but the pockets can be on a top side i.e. along a side closest to the wear's neck.

One or more pieces of padding or cushioning material that helps to provide collarbone protection from impact for the wearer. The pieces of padding are secured in between the outer and inner layer of the garment by means of a pocket, Velcro®, or any other type of non-permanent application, and can be inserted from the top, bottom, any side, or inside. The pieces of padding overlay the clavicles of a user when the garment is being worn by the user.

Example of Shoulder Pad

Figure 42:
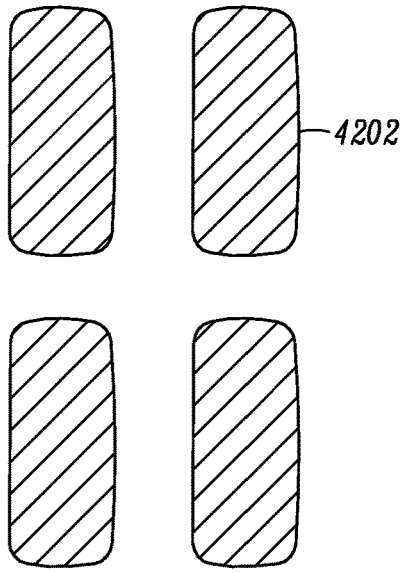
FIG. 42 is a front view of a shoulder pad embodiment of a cushioning pad.

FIG. 42 is a front view of a shoulder pad embodiment of a cushioning pad 4202.

Figure 43:
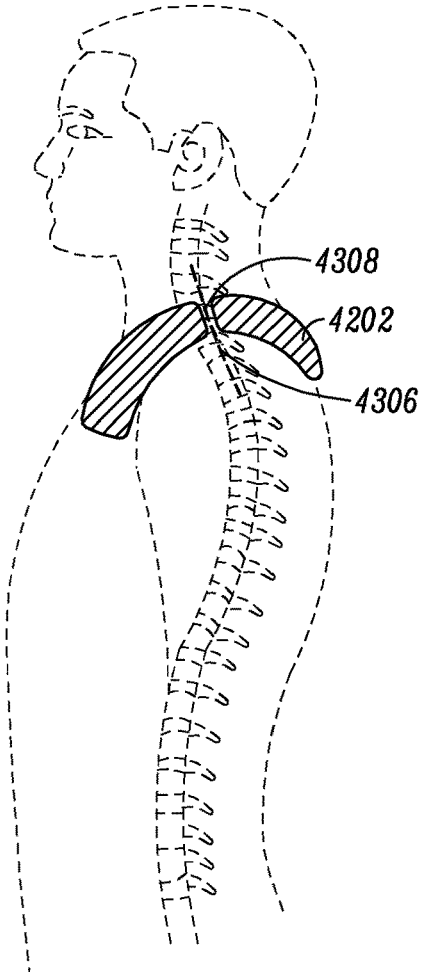
FIG. 43 is a side perspective view showing the placement of the shoulder pad embodiment of the cushioning pad of FIG. 42 inside a shirt.
Figure 45:
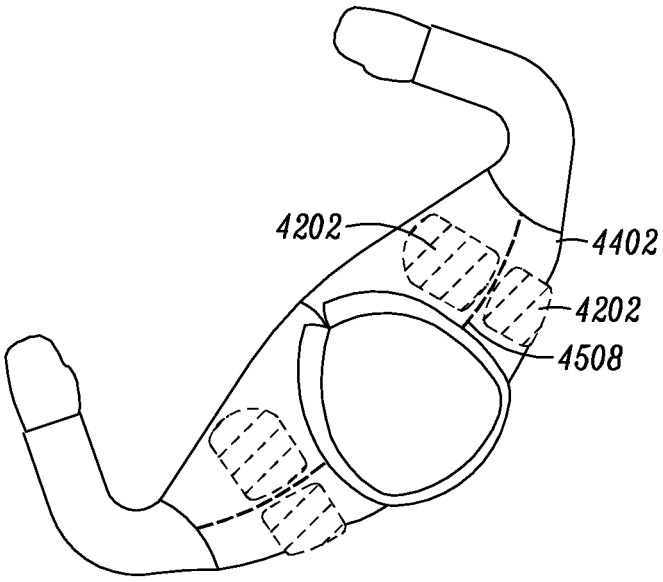
FIG. 45 is a top perspective view showing the placement of the shoulder pad embodiment of the cushioning pad of FIG. 42 inside a shirt.

FIG. 43 is a side perspective view showing the placement of the shoulder pad embodiment of the cushioning pad 4202 inside a shirt. Notice that two pads are position on either side of a garment seam 4308 at the top of the shoulder 4306. This is also shown in FIG. 45 a top perspective view showing the placement of the shoulder pad embodiment of the cushioning pad 4202 on either side of a garment 4402 seam 4508.

Figure 44:
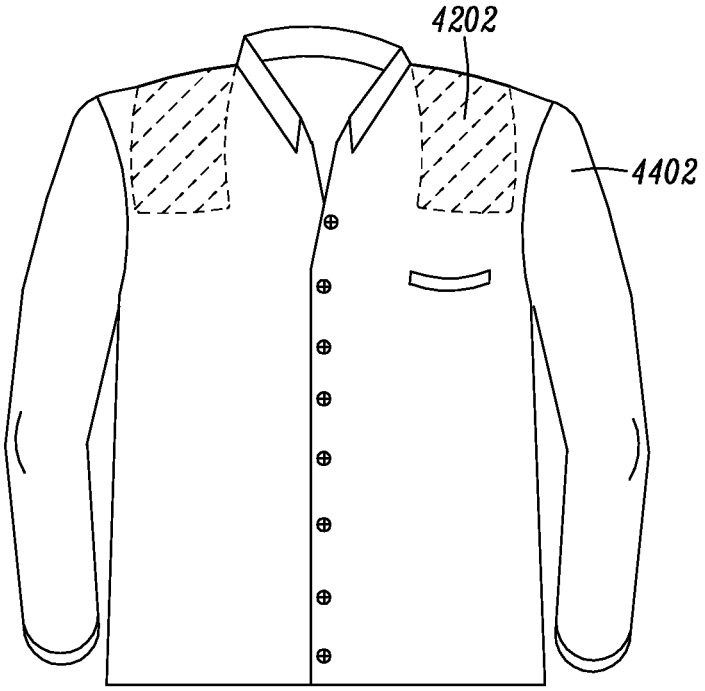
FIG. 44 is a front view showing the placement of the shoulder pad embodiment of the cushioning pad of FIG. 42 inside a shirt.

FIG. 44 is a front view showing the placement of the shoulder pad embodiment of the cushioning pad 4202 inside a shirt 4402.

Figure 46:
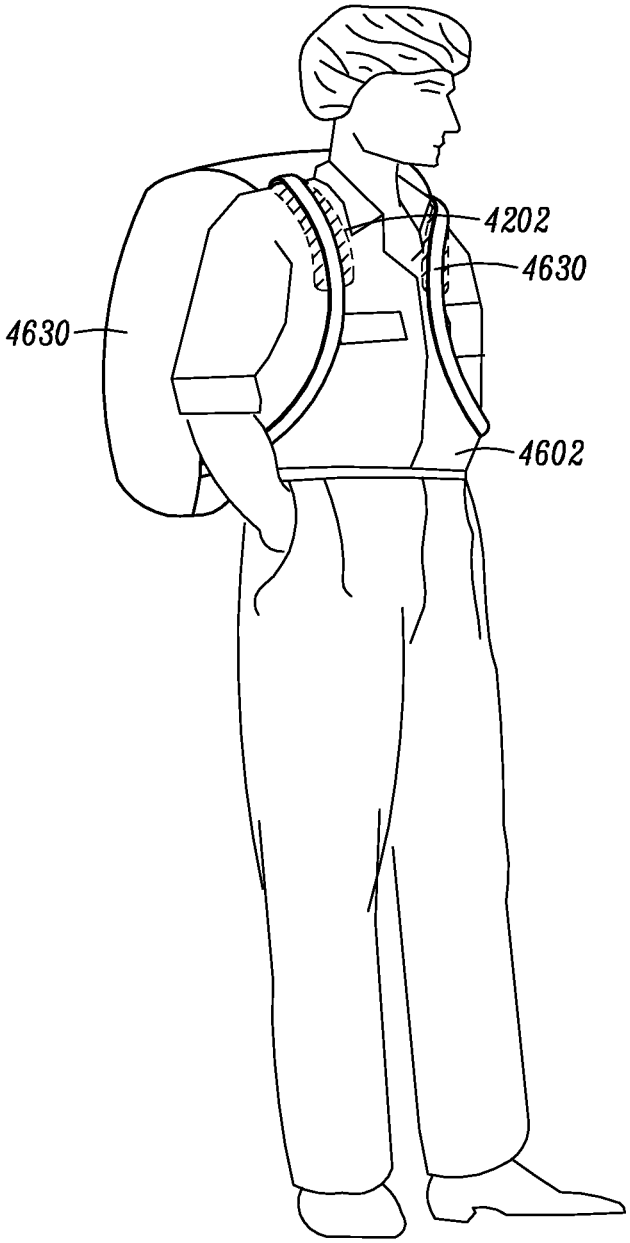
FIG. 46 is a front perspective view showing the placement of the shoulder pad embodiment of the cushioning pad of FIG. 42 inside a shirt to provide cushioning to backpack straps of a backpack.

FIG. 46 is a front perspective view showing the placement of the shoulder pad embodiment of the cushioning pad 4202 inside a garment 4602 to provide cushioning to backpack straps 4632 of a backpack 4630.

Figure 47:
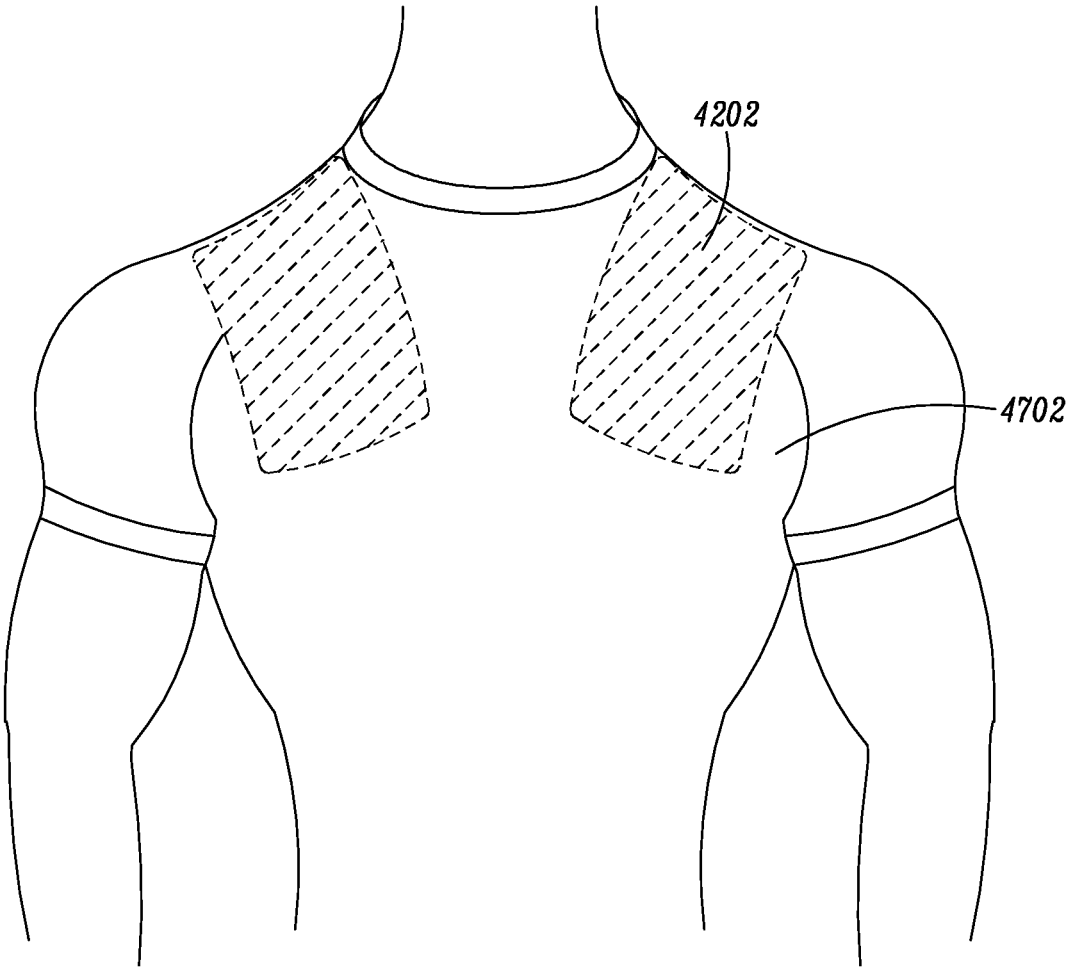
FIG. 47 is a front view showing the placement of the shoulder pad embodiment of the cushioning pad of FIG. 42 inside a shirt.

FIG. 47 is a front view showing the placement of the shoulder pad embodiment of the cushioning pad 4202 inside a shirt 4702.

Figure 48:
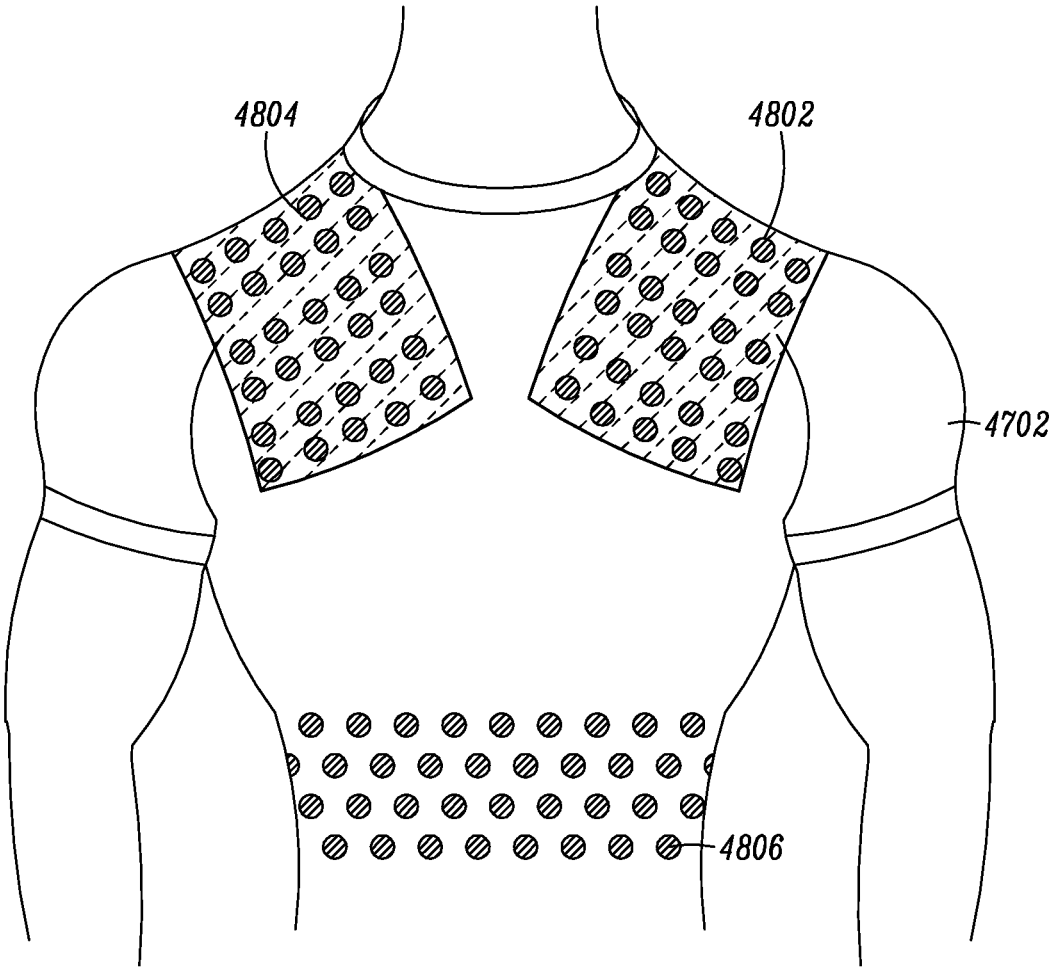
FIG. 48 is a front view showing the placement of the shoulder pad embodiment of the cushioning pad of FIG. 42 inside a shirt with acrylic, silicon, or synthetic grip patterns disposed on the outside of the garment.

FIG. 48 is a front view showing the placement of the shoulder pad embodiment of the cushioning pad 4202 (not shown) inside a garment shirt 4702 of FIG. 47 with acrylic, silicon, or synthetic grip features 4802, 4804, and 4806 disposed on the outside of the garment 4702. The purpose of the grip features 4802, 4804, and 4806 is to prevent straps, such as backpack strap 4630 of FIG. 46 from slipping on the shirt 4702. The grip features 4802, 4804, and 4806 can be disposed in any color, any pattern on top of the garment.

This front view of a shoulder pad embodiment of a cushioning pad 4202 helps to provide shoulder protection from irritation or discomfort, bruising or impact from a load-bearing device (such as a backpack, parachute, satchel, bullet-proof vest, load bearing vest, weight vest, or plate carrier) for the wearer. The piece or pieces of padding are permanently affixed to or within the garment. It is important to note that the pad 4202 can be tapered in a longitudinal direction or latitudinal direction or both (as shown in FIG. 2 and FIG. 6). The shape and dimension of the pad 4202 can vary. The inventors have discovered that 2 mm to 7 mm thickness of the pads works advantageously. The pad 4202 can be made of neoprene, foam, or other synthetic or natural washable materials. Permanent pieces of padding are affixed to the garment either on the inside or outside layer. The piece or pieces of padding overlay the top portion of the shoulders (specifically: the Acromion, a portion of the clavicle, the top portion of the Deltoid muscle in the front, and top portion of Deltoid muscle in the back) of a user when the garment is being worn by the user.

Example of Neck Pad

Figure 49:
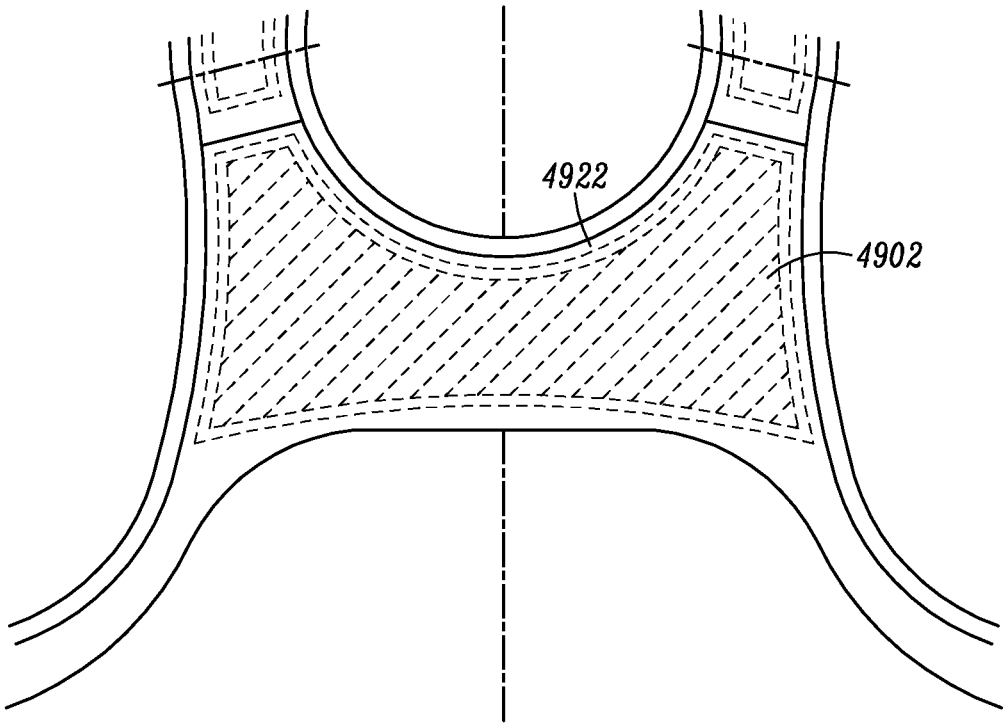
FIG. 49 is a front view of a neck embodiment of a cushioning pad.

FIG. 49 is a front view of a neck embodiment of a back of neck trapezoidal shape cushioning pad 4902. Like the example of the removable piece described above for the clavicle area, this cushioning pad 4902 includes a semicircular cutout 4922 to accommodate the wearer's neck is shown. It is important to note that the pad 4902 can be tapered in a longitudinal direction or latitudinal direction or both (as shown in FIG. 2 and FIG. 6). The shape and dimension of the pad 4902 can vary. FIG. 37 is a side view of the trapezoidal shape removable piece embodiment of the cushioning pad 3602 with depth 3610. The inventors have discovered that 2 mm to 9 mm thickness of the pads works advantageously. The pad 4902 can be made of neoprene, foam, or other synthetic or natural washable materials.

Figure 50:
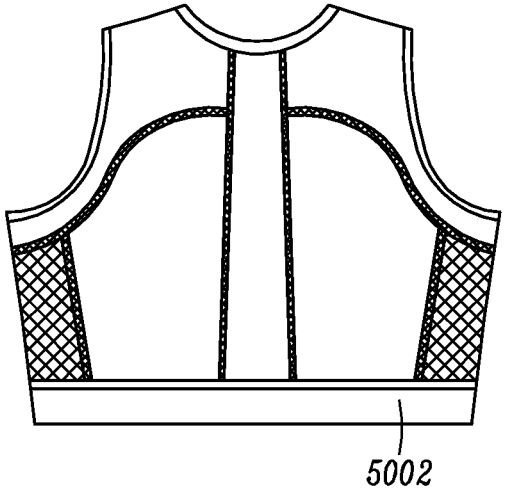
FIG. 50 is a front view showing a back portion of sports top or sports bra prior to the placement of the cushioning pad of FIG. 49.
Figure 51:
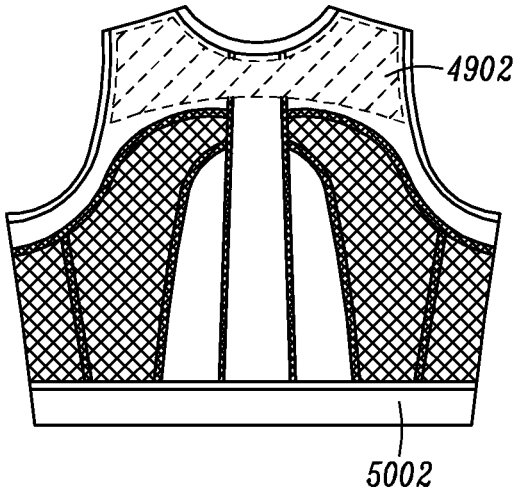
FIG. 51 and FIG. 52 is a front view showing a back portion of sports top or sports bra with the cushioning pad of FIG. 49 sewn in the neck area.
Figure 52:
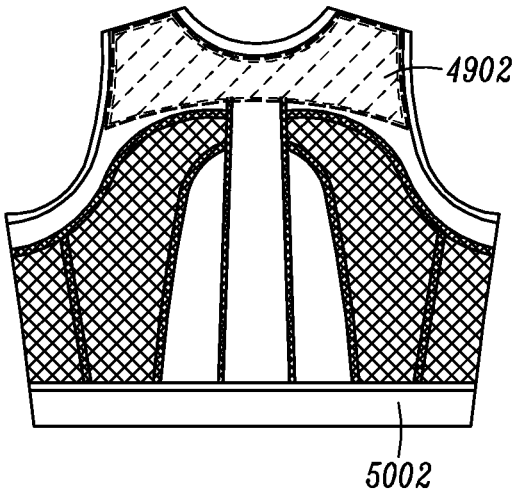

FIG. 50 is a front view showing a back portion of sports top or sports bra prior to the placement of the cushioning pad 4902. FIG. 51 and FIG. 52 is a front view showing a back portion of sports top or sports bra with the cushioning pad 4902 sewn in the neck area. The sports top can have material 4902 that is a different type and thickness along the torso as compared with the neck area 4906 including a sheen area 5002 to give an aesthetically pleasing appearance, comfort and breathability to the wearer or user.

Figure 53:
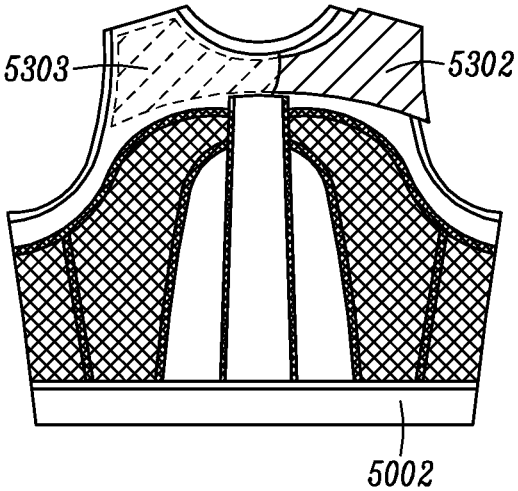
FIG. 53 is a front view showing a back portion of sports top or sports bra with the cushioning pad of FIG. 49 shown in two separate pieces.

FIG. 53 is a front view showing a back portion of sports top or sports bra with the cushioning pad of FIG. 49 shown in two separate pieces 5302, 5303.

Figure 54:
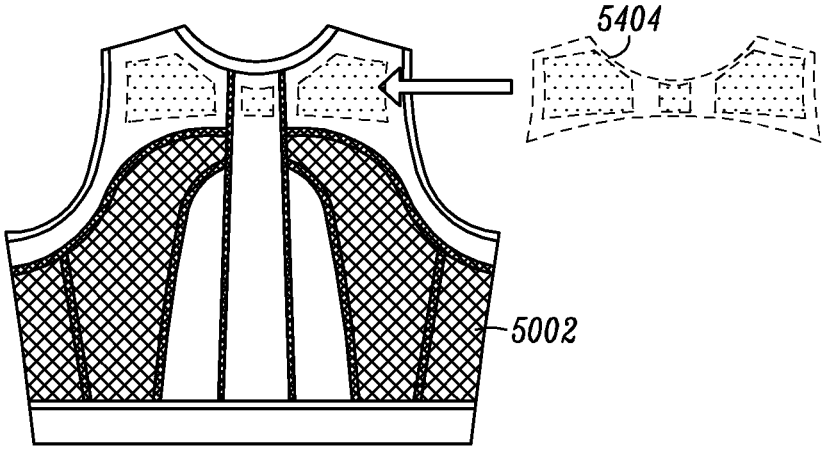
FIG. 54 is a front view showing a back portion of sports top or sports bra with the cushioning pad of FIG. 49 shown in three separate pieces.

FIG. 54 is a front view showing a back portion of sports top or sports bra with the cushioning pad 4902 shown in three separate pieces 5404.

Figure 55:
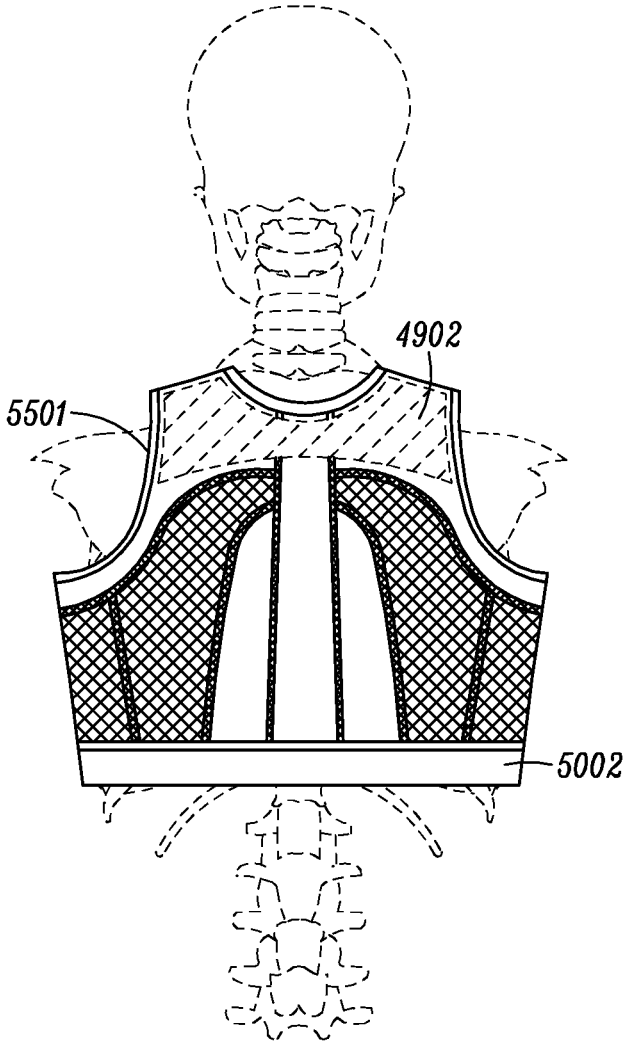
FIG. 55 is a front view showing a back portion of a sports top or sports bra with the cushioning pad of FIG. 49 within a garment to protect a neck area of a user.

FIG. 55 is a front view showing a back portion of a sports top or sports bra with the cushioning pad 4902 within a garment 5002 to protect a neck area 5101 of a user. The piece or pieces of padding 4902 are either permanent or non-permanent. Permanent pieces of padding are sewn into the garment either on the inside or outside layer. Non-permanent pieces of padding are removable, and secured in the garment by means of a pocket (inner or outer), Velcro®, or any other type of non-permanent application, and can be inserted from the top, bottom, any side, outside or inside. The piece or pieces of padding overlay the upper portion of the back of the neck (generally where a necklace closes, or more specifically: where the bottom of the cervical meets the top of the thoracic column) of a user when the garment is being worn by the user.

Example of Thigh Pad

Figure 56:
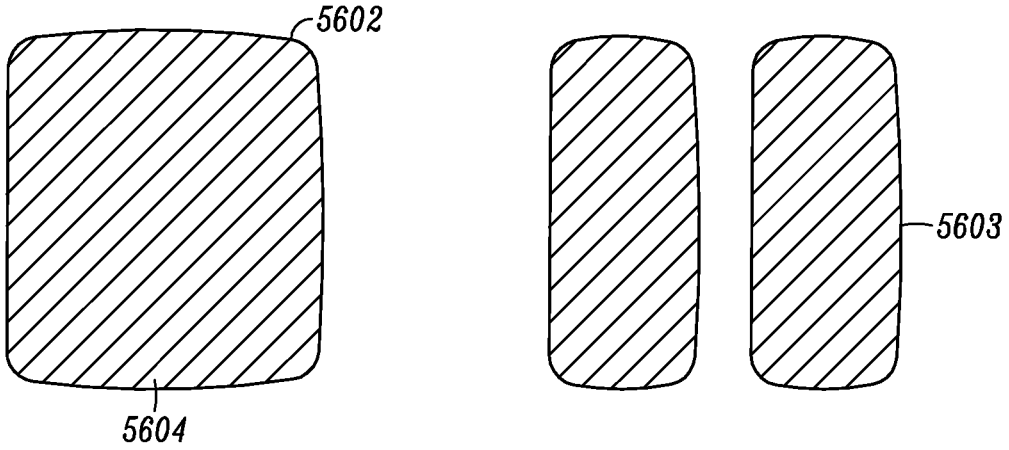
FIG. 56 is a front view of a single piece thigh embodiment of a cushioning pad.
Figure 57:
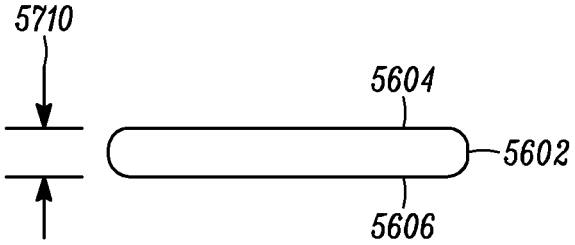
FIG. 57 is a front view of a multiple piece thigh embodiment of the cushioning pad.

FIG. 56 is a front view of a single piece thigh embodiment of a cushioning pad 5602 and 5603. FIG. 57 is a front view of a multiple piece thigh embodiment of the cushioning pad 5602, 5603 with a depth 5710. It is important to note that the pad 5602 can be tapered in a longitudinal direction or latitudinal direction or both (as shown in FIG. 2 and FIG. 6). The shape and dimension of the pad can vary. The inventors have discovered that 2 mm to 9 mm thickness of the pads works advantageously. The pad 5602 can be made of neoprene, foam, or other synthetic or natural washable materials.

Figure 58:
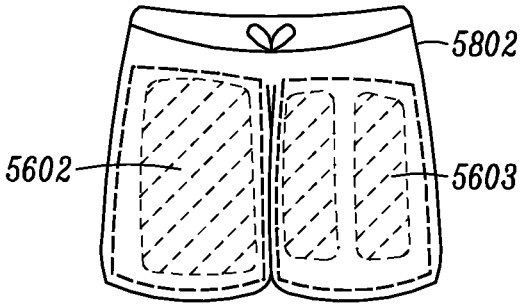
FIG. 58 is a front view showing the thigh embodiment of the cushioning pad of FIG. 56 and FIG. 57 inside pants or leggings.
Figure 59:
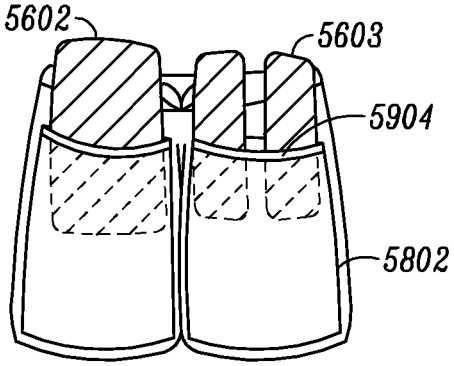
FIG. 59 is a front view showing the thigh embodiment of the cushioning pad of FIG. 56 and FIG. 57 with a pocket inside pants or leggings.

FIG. 58 is a front view showing the thigh embodiment of the cushioning pad 5602, 5603 inside pants or leggings garment 5802. FIG. 59 is a front view showing the thigh embodiment of the cushioning pad 5602, 5603 with a pocket opening 5904 inside pants or leggings garment 5802.

Figure 60:
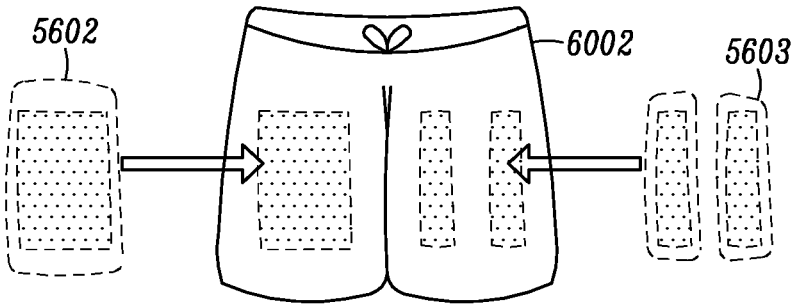
FIG. 60 is a front view showing the thigh embodiment of the cushioning pad of FIG. 56 and FIG. 57 with a pocket inside pants or leggings.

FIG. 60 is a front view of an inside out showing the thigh embodiment of the cushioning pad of FIG. 56 and FIG. 57 with a pocket inside pants or leggings garment 6002.

Figure 61:
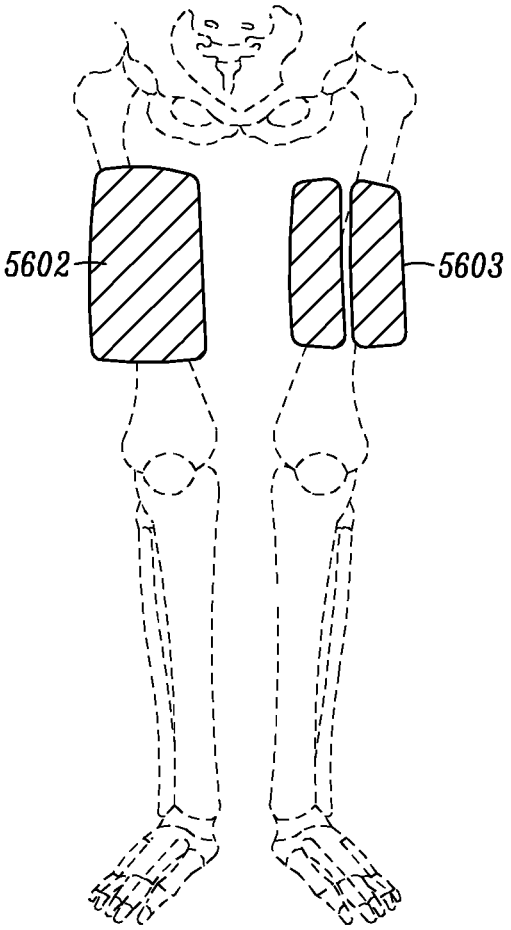
FIG. 61 is a front view showing the thigh embodiment of the cushioning pad of FIG. 56 and FIG. 57 with a pocket inside pants or leggings to protect a thigh area of a user.
Figure 62:
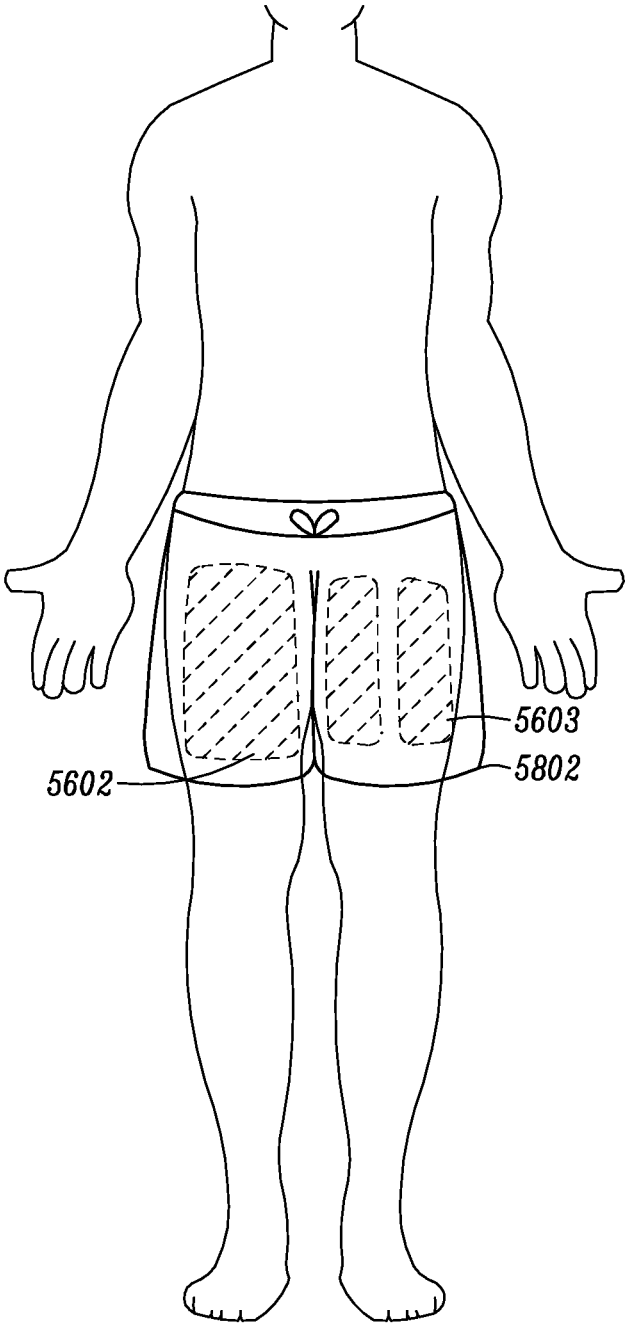
FIG. 62 is a front view showing the thigh embodiment of the cushioning pad of FIG. 56 and FIG. 57 with a pocket inside pants or leggings to protect a thigh area of a user.

FIG. 61 is a front view showing the thigh embodiment of the cushioning pad 5602, 5603 with a pocket inside pants or leggings to protect a thigh area of a user. FIG. 62 is a front view showing the thigh embodiment of the cushioning pad 5602, 5603 with a pocket inside pants or leggings to protect a thigh area of a user.

One or more pieces of padding or cushioning material that helps to provide upper, front leg protection from impact for the wearer. The pieces of padding are removable, and secured in the garment by means of a pocket (inner or outer), Velcro®, or any other type of non-permanent application, and can be inserted from the top, bottom, any side, outside or inside. The pieces of padding overlay the upper front portion of the legs (in the space between above the knee and below the hip) of a user when the garment is being worn by the user. The garment can be leggings of any length or shorts. Specifically for weightlifting movements such as hang cleans: when a barbell lifted by the user is repeatedly rested on the thigh region of the user, and also "brushed" against the quadriceps.

Example of Shin Pad

Figure 63:
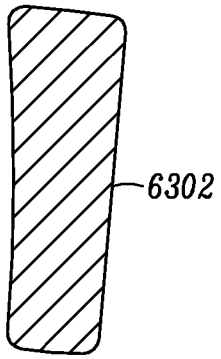
FIG. 63 is a front view showing a single piece shin embodiment of a cushioning pad.
Figure 64:
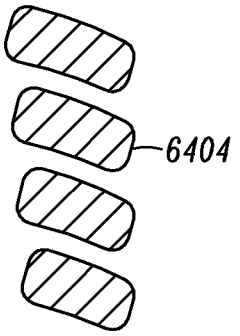
FIG. 64 is a front view of a multiple piece shin embodiment of a cushioning pad.

FIG. 63 is a front view showing a single piece shin embodiment of a cushioning pad 6302. FIG. 64 is a front view of a multiple piece shin embodiment of a cushioning pad 6304.

It is important to note that the pads 6302 and 6304 can be tapered in a longitudinal direction or latitudinal direction or both (as shown in FIG. 2 and FIG. 6). The shape and dimension of the pad can vary. The inventors have discovered that 2 mm to 9 mm thickness of the pads works advantageously. The pads 6302, 6304 can be made of neoprene, foam, or other synthetic or natural washable materials.

Figure 65:
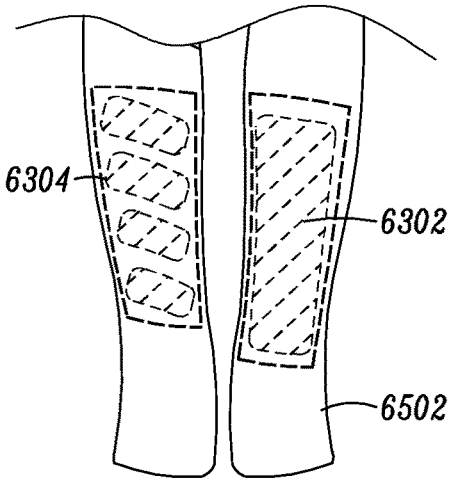
FIG. 65 is a front view of the single piece shin embodiment of the cushioning pad of FIG. 63 and the multiple piece shin embodiment of the cushioning pad of FIG. 64 shown inside pants or leggings.
Figure 66:
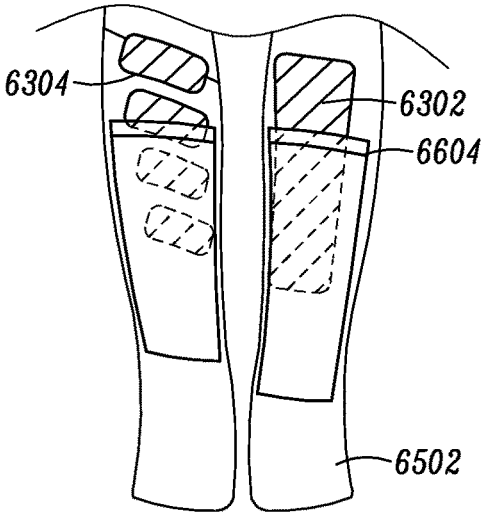
FIG. 66 is a front view of the single piece shin embodiment of the cushioning pad of FIG. 63 and the multiple piece shin embodiment of the cushioning pad of FIG. 64 shown with a pocket inside pants or leggings.

FIG. 65 is a front view of the single piece shin embodiment of the cushioning pad of FIG. 63 and the multiple piece shin embodiment of the cushioning pad 6302, 6304 shown inside pants or leggings garment 6502. FIG. 66 is a front view of the single piece shin embodiment of the cushioning pad of FIG. 63 and the multiple piece shin embodiment of the cushioning pad of FIG. 64 shown with a pocket opening 6604 inside pants or leggings garment 6502.

Figure 67:
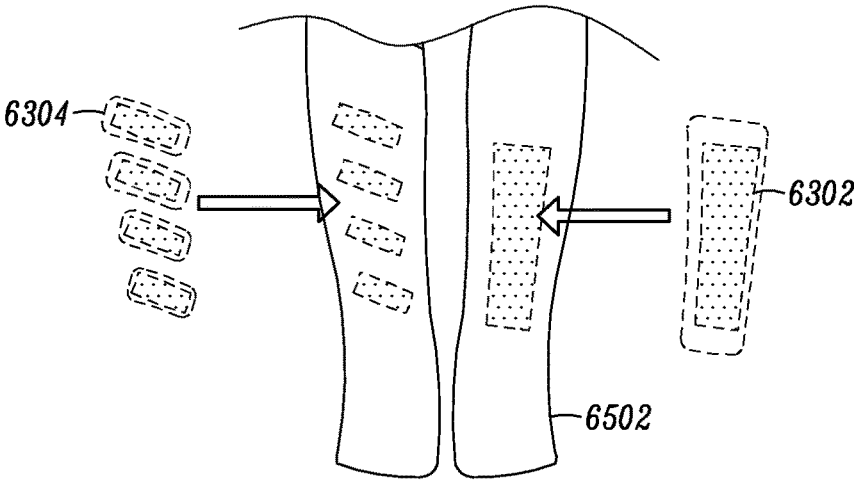
FIG. 67 is an inside out front view of the single piece shin embodiment of the cushioning pad of FIG. 63 and the multiple piece shin embodiment of the cushioning pad of FIG. 64 shown with a pocket inside pants or leggings.

FIG. 67 is an inside out front view of the single piece shin embodiment of the cushioning pad 6302, 6304 and the multiple piece shin embodiment of the cushioning pad of FIG. 64 shown with a pocket inside pants or leggings garment 6702.

Figure 68:
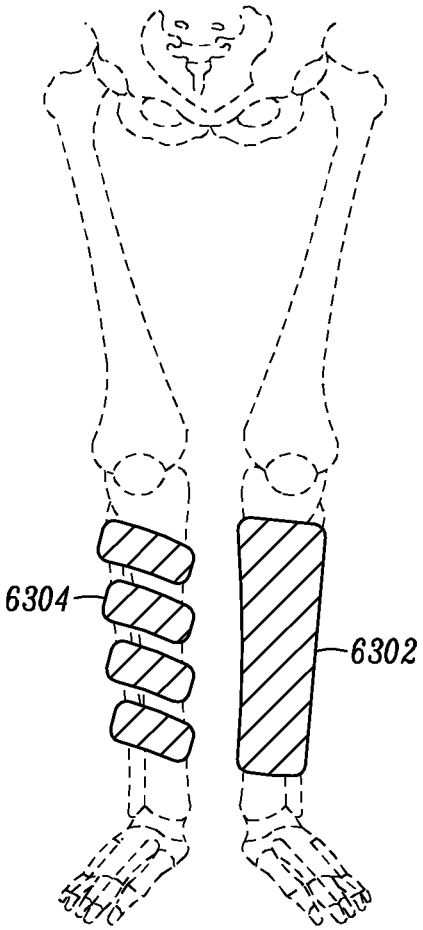
FIG. 68 is a front view of the single piece shin embodiment of the cushioning pad of FIG. 63 and the multiple piece shin embodiment of the cushioning pad of FIG. 64 to protect the shins of a user.

FIG. 68 is a front view of the single piece shin embodiment of the cushioning pad of FIG. 63 and the multiple piece shin embodiment of the cushioning pad 6302, 6304 to protect the shins of a user.

Figure 69:
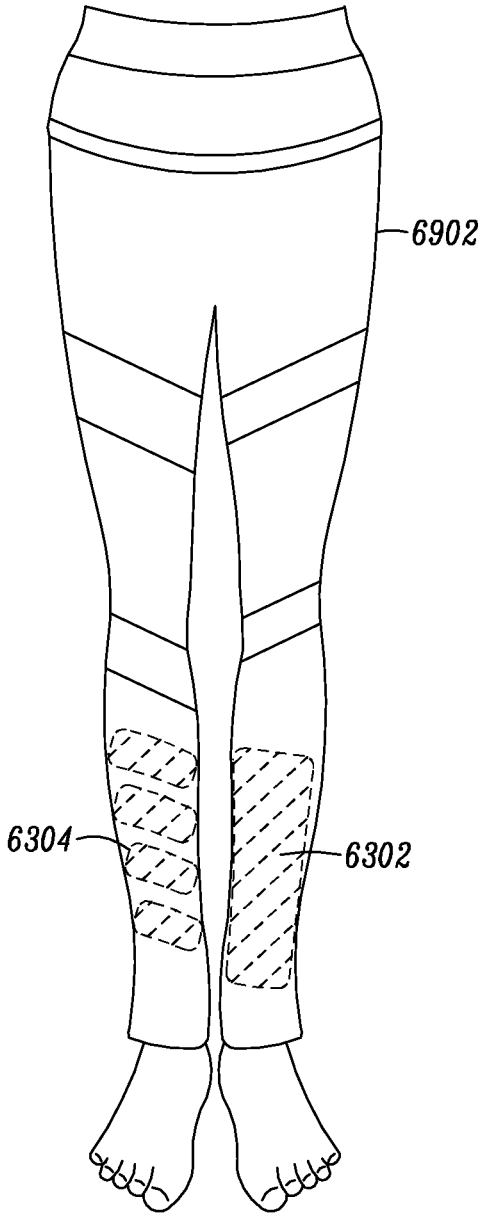
FIG. 69 is s front view of the single piece shin embodiment of the cushioning pad of FIG. 63 and the multiple piece shin embodiment of the cushioning pad of FIG. 64 shown inside pants or leggings to protect the shins of a user.

FIG. 69 is s front view of the single piece shin embodiment of the cushioning pad of FIG. 63 and the multiple piece shin embodiment of the cushioning pad 6302, 6304 shown inside pants or leggings 6302 to protect the shins of a user.

Non-Limiting Examples

The various embodiments above can be combined. The pads may be layered one on top of another to provide even more cushioning relief. The garments may be shirts, tank tops, long sleeve shirt, sleeveless shirts, sports bras as used by women, men and children.

It is important to note that the pads can be tapered in a longitudinal direction or latitudinal direction or both (as shown in FIG. 2 and FIG. 6). The shape and dimension of the pad can vary. The inventors have discovered that 2 mm to 9 mm thickness of the pads works advantageously. The garment can be made of synthetic or natural fiber materials and a combination of natural and synthetic fibers. Examples of such a synthetic fiber are nylon and spandex which is also known as elastane. In one embodiment, the fiber of the garment material is weaved as micro-mesh. The pads can be made of neoprene which is also known as polycloroprene, foam, or other synthetic or natural washable materials.

The pads may be permanently sewn in or removable. The removable pads may be disposed in pockets from any opening in a pocket within the garment or fasten with hook and loop fasteners such as Velcro® brand fasteners, or adhesive. Further the pads may be disposed inside the garment closer to the user's skin or on the outside of the garment with at least one layer of garment material between the user and the pad. Example of adhesives includes hypo-allergenic flexible acrylic.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

The invention claimed is:

1. A protective sports bra comprising:

a sports bra made of garment material, the sports bra having a center portion, two sleeve opening portions, a neck portion, an inner surface and an outer surface, wherein a section of a front portion of the sports bra defines a clavicle/collarbone area disposed beneath the neck portion; and at least one trapezoidal shaped cushioning pad with an upper side, a lower side, a left side, and a right side disposed between the outer surface and the inner surface of the sports bra, and when the sports bra is being worn by a user the at least one trapezoidal shaped cushioning pad is formed to overlay the clavicle/collarbone area of the user, with the lower side above a breast area of the user, and with the left side and the right side extend laterally from a center point between an area defined by a first rib of the user and an area defined by a third rib of the user;

wherein the at least one trapezoidal shaped cushioning pad symmetrically extends from the center point below a top of the sports bra to a left side of the sports bra and symmetrically extending from the center point below the top of the sports bra to a right side of the sports bra, defining an arc from a distal end of a left clavicle to the distal end of a right clavicle when worn by the user, and wherein the at least one trapezoidal shaped cushioning pad and the garment material at the clavicle/collarbone area form a clavicle/collarbone guard, and wherein the upper side of the at least one trapezoidal shaped cushioning pad includes an upper portion at the distal end of a right clavicle and the upper portion at the distal end of a left clavicle extends above the center point.

2. The protective sports bra of claim 1, wherein at least one of the at least one trapezoidal shaped cushioning pad is thicker in a depth extending along a direction perpendicular to the front portion of the sports bra near the center portion of the sports bra and thinner in the depth moving from the center portion towards the two sleeve opening portions of the sports bra, wherein a thickness of the at least one trapezoidal shaped cushioning pad is greater than a thickness of the garment material.

3. The protective sports bra of claim 1, wherein the at least one trapezoidal shaped cushioning pad is one of synthetic rubber, neoprene, plastic or a combination thereof.

4. The protective sports bra of claim 1, wherein the at least one trapezoidal shaped cushioning pad is fastened to the inner surface.

5. The protective sports bra of claim 4, wherein the at least one trapezoidal shaped cushioning pad is releasably, securely fastened to the inner surface by one of a hook and loop fastener and adhesive.

6. The protective sports bra of claim 4, wherein the at least one trapezoidal shaped cushioning pad is securely fastened to the inner surface by stitching.

7. The protective sports bra of claim 4, including an inner pocket on the inner surface at the clavicle/collarbone area, wherein the at least one trapezoidal shaped cushioning pad is releasably, securely fastened within the inner pocket.

8. The protective sports bra of claim 7, wherein the inner pocket is made of garment material.

9. The protective sports bra of claim 1, wherein the sports bra is a tank top.

10. The protective sports bra of claim 1, wherein the sports bra is a sleeveless sports bra.

11. The protective sports bra of claim 1, wherein the garment material is made of one of, or both, nylon and spandex.

12. The protective sports bra of claim 1, wherein the garment material is a sports bra.

13. A protective sports bra, comprising:

a sports bra with a chest portion comprising garment material and including a center portion, two sleeve opening portions, a neck portion, and a lining on a side of the chest portion that is closest to a wearer of the sports bra;

at least one trapezoidal shaped cushioning pad with an upper side, a lower side, a left side, a right side, and a depth, the at least one trapezoidal shaped cushioning pad disposed on the lining, and when the sports bra is being worn by a user the at least one trapezoidal shaped cushioning pad is formed to overlay a clavicle/collarbone area of the user, with the lower side above a breast area of the user with a length of D2, and with the left side and the right side each with a length of D1, the left side and the right side extending laterally from a center point of D2, and D2 is approximately twice the length of D1;

the at least one trapezoidal shaped cushioning pad formed thicker in the depth extending along a direction perpendicular to a front portion of the sports bra near the center portion of the sports bra and thinner moving from the center portion towards the two sleeve opening portions, the at least one trapezoidal shaped cushioning pad having a thickness greater than a thickness of the garment material; and a back portion comprising the garment material, wherein the back portion is stitched to the chest portion to form the sports bra, wherein the at least one trapezoidal shaped cushioning pad has a symmetrical shape and is securely fastened to the lining at a location such that the at least one trapezoidal shaped cushioning pad symmetrically extends from a center point to the left side of the chest portion and the right side of the chest portion, defining an arc from a distal end of a left clavicle to the distal end of a right clavicle when worn by the wearer of the sports bra.

* * * * *